US010315749B1

(12) United States Patent
Walker et al.

(10) Patent No.: US 10,315,749 B1
(45) Date of Patent: Jun. 11, 2019

(54) MATERIAL FOR PROPELLER OCCLUSION OF MARINE VESSELS

(71) Applicant: Leidos, Inc., Reston, VA (US)

(72) Inventors: Howard Walker, San Diego, CA (US); Scott Stewart, Escondido, CA (US); Richard Holmes Griffey, Vista, CA (US)

(73) Assignee: Leidos, Inc., Reston, VA (US)

( * ) Notice: Subject to any disclaimer, the term of this patent is extended or adjusted under 35 U.S.C. 154(b) by 287 days.

(21) Appl. No.: 15/071,279

(22) Filed: Mar. 16, 2016

Related U.S. Application Data

(60) Provisional application No. 62/134,511, filed on Mar. 17, 2015.

(51) Int. Cl.
*B63H 25/00* (2006.01)
*D04H 3/007* (2012.01)
(Continued)

(52) U.S. Cl.
CPC ..... *B63H 25/00* (2013.01); *D04H 3/007* (2013.01); *D04H 3/009* (2013.01); *D04H 3/018* (2013.01)

(58) Field of Classification Search
CPC ..... B63H 19/00–19/08; B63H 25/00; B63H 25/50; C08G 2230/00; C08J 2300/16; C08J 2400/16; C08K 2201/018; C08L 2201/06; C10N 2220/10; D10B 2321/06; D10B 2401/12; D10B 2403/0213; D10B 2403/024–2403/0241; D10B 2403/02421; D10B 2403/031–2403/0311; D10B 2507/02; D01F 8/00; D01F 8/04–8/18; D04H 1/4309; D04H 1/54–1/541; D04H 1/545; D04H 3/005–3/009; D04H 3/018; D04H 3/16–3/166; Y10T 428/24;
(Continued)

(56) References Cited

U.S. PATENT DOCUMENTS 6,579,814 B1 * 6/2003 Lindquist ..... A61L 15/26 428/373
6,610,900 B1 * 8/2003 Tanzer ..... A61F 13/49009 604/368
(Continued)

FOREIGN PATENT DOCUMENTS

EP 2679713 A1 * 1/2014 ..... B32B 5/022

OTHER PUBLICATIONS

Maier, C. Calafut, T.. (1998). Polypropylene—The Definitive User's Guide and Databook—7.5 Spunbonded and Melt-Blown. William Andrew Publishing/Plastics Design Library. Retrieved from https://app.knovel.com/hotlink/pdf/id:kt0019N625/polypropylene-definitive/spunbonded-melt-blown (Year: 1998).*
(Continued)

*Primary Examiner* — Marla D McConnell
*Assistant Examiner* — Larissa E Rowe
(74) *Attorney, Agent, or Firm* — Dawm-Marie Bey; Bey & Cotropia PLLC

(57) ABSTRACT

Marine vessel propulsor occlusion systems and devices made of novel fabrics formed from biodegradable and/or dissolvable materials, and methods of manufacturing and using the same are disclosed. The propulsor occlusion devices can slow and/or incapacitate a marine vessel without serious injury to occupants and without destroying the vessel's propulsion system.

22 Claims, 9 Drawing Sheets

(51) Int. Cl.
*D04H 3/009* (2012.01)
*D04H 3/018* (2012.01)

(58) Field of Classification Search
CPC ..... Y10T 428/24033–428/24058; Y10T 428/24074–428/24091; Y10T 428/24124; Y10T 428/24273–428/24347; Y10T 428/25; Y10T 428/27; Y10T 428/2822; Y10T 428/2916; Y10T 428/2927–428/2931; Y10T 442/10–442/102; Y10T 442/105; Y10T 442/133; Y10T 442/184–442/186; Y10T 442/191; Y10T 442/3033–442/3041; Y10T 442/3065–442/3171; Y10T 442/637–442/642; Y10T 428/15; Y10T 428/169; Y10T 428/23993; Y10T 428/24132; Y10T 428/2476; Y10T 428/249921; Y10T 428/429922; B63B 2742/00–2742/02; B63B 22/10; B63G 9/04; F41H 11/05; F41H 13/00; B32B 2305/184; B32B 7/06; B32B 7/12–7/14; D04C 1/12
USPC ..... 428/98, 107–109, 113, 131–140, 428/219–220, 323, 340, 348, 366, 428/372–374, 36.3, 101–105, 189–190, 428/194; 442/1–2, 4, 20, 50–51, 54, 442/185–186, 189–202, 334–337, 442/361–365; 440/113; 102/399, 102/504–505; 89/1.34; 87/7, 8–11
See application file for complete search history.

(56) References Cited

U.S. PATENT DOCUMENTS

| | | | | |
|---|---|---|---|---|
| 2002/0074697 | A1* | 6/2002 | Steinke | D04H 3/10 264/504 |
| 2006/0012072 | A1 | 1/2006 | Hagewood et al. | 264/176.1 |
| 2009/0026401 | A1* | 1/2009 | Dobkins | B65B 31/047 251/149.6 |
| 2011/0174140 | A1* | 7/2011 | Brewer | B63B 1/32 89/1.34 |
| 2012/0164905 | A1* | 6/2012 | Topolkaraev | D01F 8/14 442/364 |
| 2013/0101805 | A1* | 4/2013 | Altshuler | B32B 5/022 428/172 |

OTHER PUBLICATIONS

American Society for Testing and Materials (ASTM) Standard D2256M-10, Standard Test Method for Tensile Properties of Yarns by the Single-Strand Method, Jul. 2010, 13 pp.
ASTM Standard D2731-07 (Reapproved 2012)—Standard Test Method for Elastic Properties of Elastomeric Yarns (CRE Type Tensile Testing Machines), Aug. 2012, 5 pp.
ASTM Standard D6691—Standard Test Method for Determining Aerobic Biodegradation of Plastic Materials in the Marine Environment by a Defined Microbial Consortium or Natural Sea Water Inoculum, Dec. 2009.
ASTM Standard D7473-12—Standard Test Method for Weight Attrition of Plastic Materials in the Marine Environment by Open System Aquarium Incubations, Jun. 2012, 4 pp.
ASTM Standard D5511-12—Standard Test Method for Determining Anaerobic Biodegradation of Plastic Materials Under High-Solids Anaerobic-Digestion Conditions, 2012, 7 pp.
ASTM Standard D5988-12—Standard Test Method for Determining Aerobic Biodegradation of Plastic Materials in Soil, 2012, 6 pp.
ASTM Active Standard ASTM D570-98 (reapproved 2010)—Standard Test Method for Water Absorption of Plastics, 2010, 4 pp.
Eden Research Laboratory, "Update—Leidos—ASTM D5511 (38 Days)," Feb. 12, 2015, 2 pp.
Eden Research Laboratory, "Update—Leidos—ASTM D5988 (78 Days), " Mar. 4, 2015, 1 p.
"Polymer Kelp for Vessel Stopping/Draft White Paper/Refinement of Polymer Kelp Material for Deployment," Leidos, Surveillance and Reconnaissance Business Unit, Contract No. W91CRB-11-D-0001-0067, 10 pp., Feb. 25, 2015.
"Polymer Kelp for Vessel Stopping/Model Scale Material Specifications," Leidos, Surveillance and Reconnaissance Business Unit, Contract No. W91CRB-11-D-0001-0067, 13 pp., Feb. 23, 2015.
"Polymer Kelp for Vessel Stopping/Laboratory Test Plan for Developing Polymer Kelp Material," Leidos, Surveillance and Reconnaissance Business Unit, Contract No. W91CRB-11-D-0001-0067, 7 pp., Feb. 11, 2015.
"Intermediate Scale Material Specification," 5 pp., Aug. 26, 2014.
"Full Scale Material Specifications," 2 pp.
"Polymer Kelp for Vessel Stopping/vol. 1, Technical Proposal," Leidos, Contract No. W91CRB-11-D-0001, 12 pp., Mar. 7, 2014.
"An In-Scope Proposal for: Polymer Kelp Vessel Stopping/Technical Proposal," Leidos, Inc., Contract No. W91CRB-11-D-0001, Task Order 0067, 10 pp., Aug. 29, 2014.
Kaiyan Qiu and Anil N. Netravali, "Polyvinyl Alcohol Based Biodegradable Polymer Nanocomposites" [online]. Biodegradable Polymers, vol. 1, ISBN: 978-1-63483-632-6, EBSCO Publishing, eBook Collection (EBSCOhost) Copyright 2015 [printed on Feb. 23, 2016], via Judson College, 56 pp.

* cited by examiner

MATERIAL FOR PROPELLER OCCLUSION OF MARINE VESSELS

CROSS-REFERENCE TO RELATED APPLICATIONS

The present application claims benefit of U.S. provisional patent application Ser. No. 62/134,511, titled "Material For Propeller Occlusion Of Marine Vessels," filed Mar. 17, 2015, which is incorporated by reference herein in its entirety.

STATEMENT REGARDING FEDERALLY SPONSORED RESEARCH FOR DEVELOPMENT

Embodiments disclosed herein may have been conceived or first actually reduced to practice in performance of work under the following Government contract: Performance Work Statement (PWS) for Polymer Kelp for Vessel Stopping which is contained within contract W91CRB-11-D-0001 dated Mar. 21, 2014, issued by US Army RDECOM ACQ CTR-W911N F, 4300 S. Miami Blvd, Durham N.C. 27703. As a result, the Government may have certain rights to those embodiments.

FIELD OF THE EMBODIMENTS

The present embodiments relate generally to novel propulsor occlusion devices for stopping, slowing or disabling a seafaring vessel, ship, boat or the like, and methods of manufacturing and using these novel devices. Specifically, the present embodiments relate to propulsor occlusion devices comprising novel fabrics formed from biodegradable and/or dissolvable materials, and methods of manufacturing and using the same.

BACKGROUND OF THE EMBODIMENTS

There are a variety of circumstances in which it may become necessary for an official to compel a marine vessel (e.g., a ship, boat, jet ski, submarine or the like) to slow or to come to a complete stop. For example, an official may need to slow or stop a vessel during a law enforcement, drug interdiction, migrant interdiction or marine environmental protection mission.

The problem is that operators engaged in illegal activities tend to run when confronted by law enforcement. Officials are precluded from using lethal means to stop fleeing vessel unless they are fired upon. Accordingly, a dangerous chase often ensues as officials attempt to stop the fleeing vessel with non-lethal entanglement devices.

As shown in FIG. 1, conventional entanglement devices 102 are primarily in the form of nets or line materials launched ahead of a fleeing vessel with the hope that the vessel will travel over the extended line and pull it into the vessel's propeller 101. These systems suffer from a number of drawbacks. First, the vessel operator typically sees the entanglement device being launched and so they may elude it by simply steering away from the device in the water. Second, such devices work by entangling the propeller and causing the drive train to stop. Accordingly, the operator may cause significant damage to an entangled motor by increasing the power to attempt to continue forward motion. Third, such devices must be removed from the water quickly after they are deployed. Nets and lines pose a danger to wildlife (e.g., birds, fish and the like) and other vessels when left in the water for an extended period of time.

Recently, an attempt has been made to produce entanglement devices that dissolve or degrade when left in the water for an extended period of time. Unfortunately, many of these devices either lack the strength necessary to slow or stop marine vessels, or are made from poorly degrading plastic polymers such as polypropylene, polyethylene terephthalate, and/or aliphatic polyamides that have the potential to leave residual plastic debris in the waters for periods well beyond their intended use and purpose.

There remains a need for improved devices, materials, and methods to facilitate stopping or slowing of a maritime vessel. It would be beneficial if such materials had reduced deleterious effects on vessels and their operators so such devices could be deployed earlier in an engagement, even before hostile intent is established. It would be further beneficial if such devices were made from biodegradable and/or dissolvable materials so that they did not require officials to retrieve them after deployment. Such systems would need to be able to stop or slow specific maritime targets in different environments, under varying conditions, and in multiple scenarios.

BRIEF SUMMARY OF THE EMBODIMENTS

In accordance with the foregoing objectives and others, it is an object of the present embodiments to provide a system that can slow and/or stop a seagoing vessel via occlusion of its propulsor.

Another object of the present embodiments is to provide a system that can be deployed from above, below, and/or on the surface of a body of fresh or salt water.

Yet another object of the present embodiments is to provide a propulsor occlusion device incorporating a number of fabrics or yarns made from a combination of dissolvable and/or biodegradable materials manufactured in such a way as to provide a lightweight, compact and low-regret method to stop or slow marine vessels by occlusion of any type of marine propulsor.

In one aspect of the embodiments an propulsor occlusion device is provided for use in slowing a marine vessel in a body of water. The device may include one or more strips of fabric having a basis weight of from about 75 to about 150 $g/m^2$ (GSM), for example about 100 GSM. The strips of fabric may be made of bonded fibers that include from about 65% to about 80% by weight polyvinyl alcohol and from about 20% to about 35% by weight polylactic acid. The propulsor occlusion device may be adapted to adhere to a propulsor of a marine vessel to reduce the propulsor's thrust generation and thereby slow the marine vessel.

In another aspect of the embodiments, a propulsor occlusion system for use in slowing a marine vessel in a body of water is provided. The system includes a vacuum-sealable, flexible housing adapted to hold a propulsor occlusion device therein. In one embodiment, a propulsor occlusion device may be housed in the housing, and air may be removed to reduce the volume of the system. The device may include a fabric made from a plurality of bonded bicomponent fibers having a sheath of from about 65% to about 80% by weight polyvinyl alcohol and a core of from about 20% to about 35% by weight polylactic acid. The propulsor occlusion device may be adapted to adhere to a propulsor of a marine vessel to reduce the propulsor's thrust generation and thereby slow the marine vessel.

In yet another aspect of the embodiments, a spunbond nonwoven fabric for use in slowing a marine vessel in a body of water is provided. The fabric may be made up of a plurality of bonded fibers having a sheath-core geometry, with a sheath of about 70% by weight polyvinyl alcohol and a core of about 30% by weight polylactic acid. The fabric may also include one or more superabsorbent materials. The fabric may have a basis weight of about 100 GSM and a denier per filament of about 3. This fabric may be adapted to adhere to a propulsor of a marine vessel.

These and other aspects of the embodiments may be more clearly understood by reference to the following detailed description and the appended claims.

BRIEF DESCRIPTION OF THE DRAWINGS

The preferred embodiments are illustrated by way of example and not limited to the following figures.

DETAILED DESCRIPTION OF THE EMBODIMENTS

Figure 1:
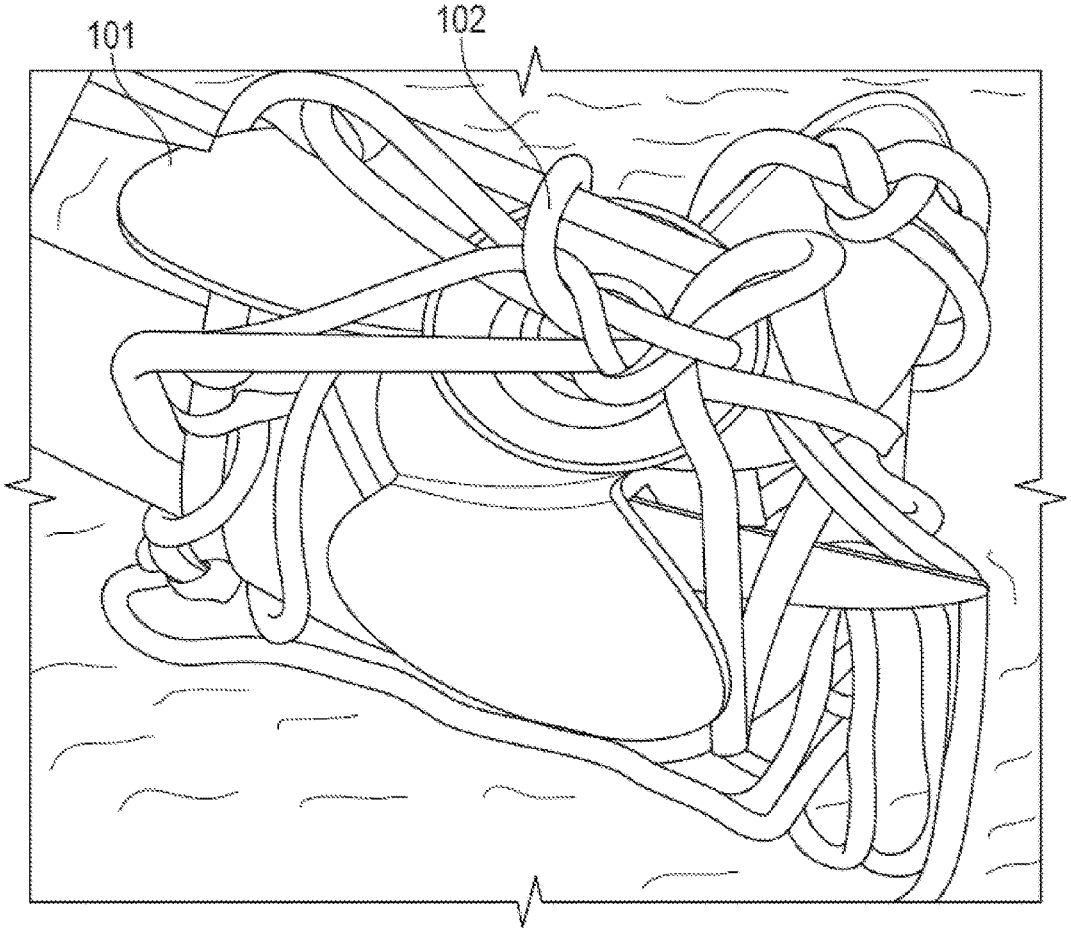
FIG. 1 (Prior Art)
FIG. 1 shows a conventional entanglement device 102 wrapped around a propeller 101.

Various embodiments will be described with reference to details discussed below, and the accompanying drawings will illustrate the various embodiments. The following description and drawings are illustrative and are not to be construed as limiting the embodiments. Numerous specific details are described to provide a thorough understanding of various embodiments. However, in certain instances, well-known or conventional details are not described in order to provide a concise discussion of the embodiments.

As required, detailed embodiments are disclosed herein. However, it is to be understood that the disclosed embodiments are merely exemplary. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the embodiments. While best mode is described, not all embodiments contain all features described herein. The individual features described herein relate to an exemplary composite of various embodiments.

All terms used herein are intended to have their ordinary meaning in the art unless otherwise provided. Where reference is made to the composition of the propulsor occlusion devices, the components are given in terms of "% by weight," which refers to the weight percent of each component based on the weight of the entire composition.

Generally speaking, the present embodiments are directed to a new, non-lethal watercraft immobilizing devices and system, including novel fabrics that make up the systems, and methods of manufacturing the same. The propulsor occlusion devices comprise one or more fabrics made from fibers comprising biodegradable and/or dissolvable materials.

The disclosed propulsor occlusion devices can be deployed from a position above, below or on the surface of a body of water. Marine propulsors are designed to propel a watercraft by moving water in various ways, for example, through open or enclosed propellers, through jet engines and through cooling systems. It will be appreciated that the disclosed propulsor occlusion devices may move with this water to occlude a vessel's propulsor.

Embodiments of propulsor occlusion devices comprise a combination of hydrophilic, dissolvable and/or biodegradable materials manufactured in such a way as to provide a lightweight, compact and low-regret method to slow or stop marine platforms by occlusion of any type of marine propulsor.

The propulsor occlusion devices must meet a number of performance requirements that, taken together, impose significant constraints on the formulation not met by currently available materials. For example, propulsor occlusion materials must meet requirements relating to: water absorption rate, tensile strength, shape factors, thermal properties, strength in water, degradation in water, buoyancy in water, changes due to salinity and/or temperature variations, and/or biodegradability.

Figure 2:
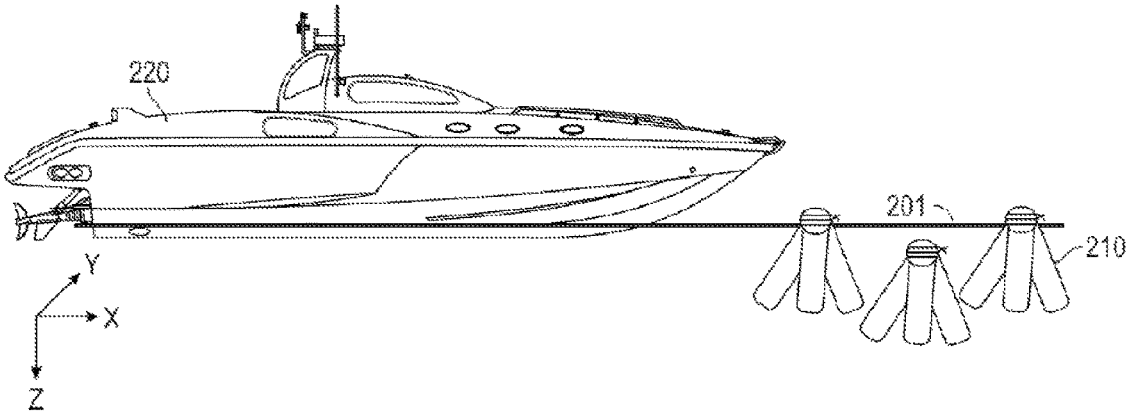
FIG. 2 shows exemplary entanglement materials 210 deployed below the surface of the water 201 in a forward path of a marine vessel 220.

Referring to FIG. 2, a number of propulsor occlusion devices 210 are illustrated as being deployed in a body of water 201. As shown, the propulsor occlusion materials 210 may be deployed near the surface of the water 201 in a forward path of a marine vessel 220. One or more propulsor occlusion devices 210 may be deployed such that a single device or a combination of devices extend across the beam of the target vessel, ensuring intercept.

The propulsor occlusion devices 210 typically create a projected, but discontinuous barrier. Rather than creating a perimeter of the material, discrete lengths may be employed to target singular encounters.

Ideally, the materials are deployed such that the vessel 220 will travel directly over the material. Upon deployment, the total density of the wetted material should be at or just slightly below the density of water if it is to remain on or within close proximity of the surface. Moreover, the propulsor occlusion material may be diaphanous, such that it moves easily with the surrounding water. This may increase the likelihood that the material becomes entrapped by a vessel's propulsor.

Figure 3A:
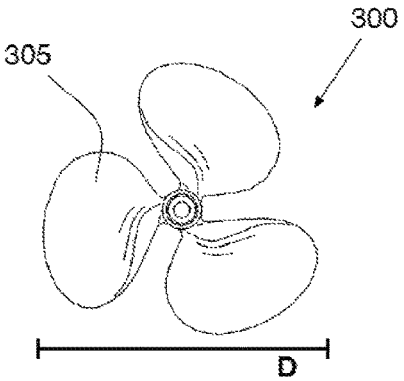
FIGS. 3A-3B show an exemplary marine propulsor 300 in a first state (FIG. 3A) before coming into contact with propulsor occlusion materials 310 and in a second state (FIG. 3B) after engagement with the materials 310.
Figure 3B:
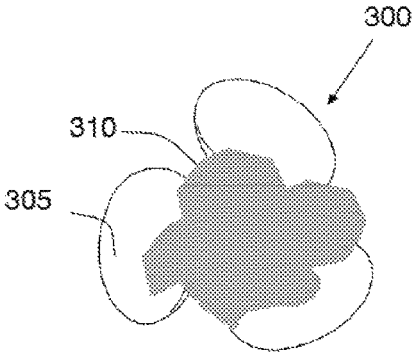

Referring to FIGS. 3A-3B, a propeller 300 having multiple airfoil-shaped blades 305 is illustrated in a first state (FIG. 3A) before it comes into contact with propulsor occlusion materials 310 and in a second state (FIG. 3B) after coming into contact with the materials (FIG. 3B).

The propeller 300 comprises a "diameter" D equal to the diameter of a circle located at the distal-most ends of the propeller blades 305. Generally, the propeller transmits power by converting rotational motion into thrust. A pressure difference is produced between the forward and rear surfaces of each blade, and water is accelerated behind the blade.

As shown, the propulsor occlusion materials 310 may be drawn into the propeller blades 305 and may become fastened, adhered or stuck thereto. The added mass and irregular volume of the materials interfere with propeller's capability to generate thrust. The stopping power of the propulsor occlusion materials thus cannot be overcome by increasing power. Importantly, the propulsor occlusion materials do not prevent the propeller from rotating like conventional entanglement device, so increasing power may not result in damage to an engine or drivetrain.

The inventive propulsor occlusion devices may be employed to occlude any type of inboard or outboard marine propeller systems, including but not limited to twin, contra-rotating, controllable-pitch, and nozzle-style propellers. Moreover, the propulsor occlusion devices may be employed to stop and/or slow vessels having twin, triple or quadruple blade propellers.

In certain embodiments, the propulsor occlusion device may be capable of stopping a vessel having any number of propellers, each of up to about 10 inches, about 15 inches, about 20 inches, about 30 inches, about 35 inches, about 40 inches, about 45 inches or about 50 inches in diameter. The propulsor occlusion materials are capable of occluding propellers having any blade contour and pitch.

Although a propeller is depicted, it will be appreciated that the propulsor occlusion materials be an effective non-lethal means of stopping and/or slowing a vessel having any type and/or number of propulsors, such as but not limited to propellers and/or jet drives. The material is effective at stopping and/or slowing vessels having displacement hulls or those having planing hulls.

In order to maintain the occlusion mechanism, the propulsor occlusion materials should comprise a tensile strength that is strong enough to hold together under the forces generated at the lifting surfaces of a vessel's propulsor(s). In certain embodiments, the propulsor occlusion device may be designed such that it will break if put under strong tensile forces to assure is does not stop a vessel's drive train. The tensile strength of the material may be engineered for specific engagements.

Tensile strength of the propulsor occlusion materials may be measured according to ASTM Standard D2256, Standard Test Method for Tensile Properties of Yarns by the Single-Strand Method; and/or ASTM Standard D2731 Standard Test Method for Elastic Properties of Elastomeric Yarns (CRE Type Tensile Testing Machines).

Characterization of the tensile strength of the material in water is different from dry tensile strength. Although tensile strength data can be obtained quantitatively in the dry state, measurement in the wet state is more difficult. There is no standard method for measuring tensile strength in water. However semi-quantitative measurements may be correlated with effectiveness in occlusion.

Referring to FIGS. 4A-4E, a number of exemplary propulsor occlusion device geometries are illustrated. As shown, the propulsor occlusion devices comprise one or more strips, sections or pieces of a propulsor occlusion fabric material 410. A single fabric section may be employed, or a number of sections may be fastened together to form a shape for the device. It will be appreciated that the illustrated shapes are exemplary and any geometry may be employed as long as the resulting device meets the requirements described herein.

Figure 4A:
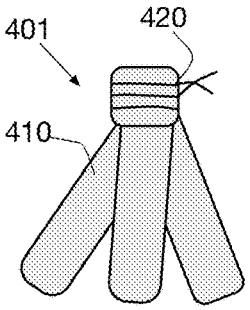
FIGS. 4A-4E show a number of exemplary propulsor occlusion device geometries.

Referring to FIG. 4A, an exemplary engagement device 401 is illustrated having a number of material strips 410 fastened together at or near a single end of each strip, via a fastening means 420. Any number of material strips may be employed in the illustrated configuration.

The fastening means 420 may comprise one or more of: rope, yarn, thread, ties, crimps, staples, chemical adhesives, thermal bonding techniques and the like. In one preferred embodiment, the strip ends may be sewn together using biodegradable and/or dissolvable materials having any desired or required strength.

Figure 4B:
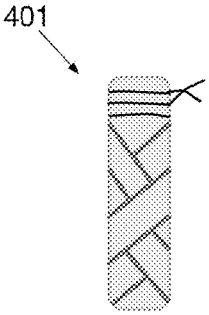

Referring to FIG. 4B, the exemplary engagement device 401 of FIG. 4A is shown, wherein the strips 410 are braided, twisted or otherwise combined to reduce the volume of the device before it is deployed.

Although the strips 410 are shown as being braided together, it will be appreciated that the shape of the device 401 may change substantially when submerged in water. Typically, the strips 410 absorb water quickly upon deployment, and the non-fastened ends will expand and separate from each other. The fastening means may remain attached to one end of the strips for a period of time before the materials dissolve and/or biodegrade.

Figure 4C:
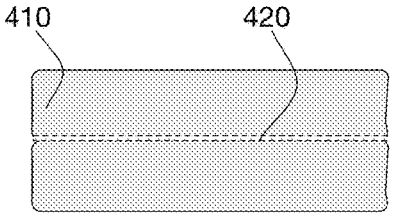

Referring to FIG. 4C, an exemplary engagement device is illustrated comprising a number of material sections 410 fastened together along a side thereof, via a fastening means 420. The material strips are combined to form a "double-wide" configuration. It will be appreciated that any number of strips may be fastened together to increase the width (and/or length) of the engagement device.

Figure 4D:
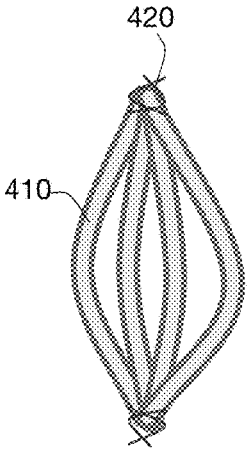

Referring to FIG. 4D, an exemplary propulsor occlusion device is shown wherein a number of material piece 410 are attached via a fastening means 420 at both a top end and bottom end thereof to form a spherical shape. Although four fabric strips are depicted, it will be appreciated that any number of strips may be employed to increase or decrease the overall density of the device.

Figure 4E:
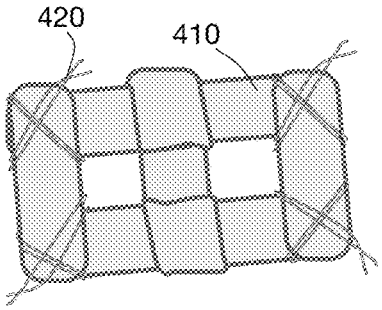

Referring to FIG. 4E, an exemplary propulsor occlusion device is shown wherein a number of material strips 410 are attached to form of a net-like structure. Any number of fabric pieces may be combined into such a shape, depending on the desired length and/or width of the net. Again, the multiple strips of material 410 may be fastened together via one or more of the above-described fastening means 420.

Although not shown, multiple propulsor occlusion devices may be attached via an attachment means to create a grouping of propulsor occlusion devices. Any attachment means may be employed, including but not limited to, rope, yarn, thread, ties or the like. Preferably, the attachment means is dissolvable and/or biodegradable. The attachment means may be physically connected to a fabric strip of each device, or may be attached to a fastening means present on each propulsor occlusion device. A grouping of propulsor occlusion devices may be preferred in certain situations, such as when it is desired to cover a large area, a strong current is present, or when multiple vessels are targeted.

The propulsor occlusion device geometry may be selected such that the device may move with the surrounding water. Accordingly, the geometry of the propulsor occlusion device may allow for it to be pliable and/or drapable. The drapability of the device (i.e., a radius of curvature of the drape) may be specifically engineered based on the characteristics of the propulsor desired to be occluded. For example, large propellers may not require the drapability that smaller ones do.

It will be appreciated that the propulsor occlusion materials may simply be employed as a single strip of material. A number of exemplary single-strip devices are shown in FIGS. 10-13 and are discussed in detail below. Moreover, a fastening means may not be employed, as the material strips may simply be tied together to allow for separation after deployment.

Selection of appropriate dimensions for the fabric strips or panels is important, as it affects the probability of prop occlusion and a number of environmental factors, such as degradation of material (discussed below). Generally, a larger volume of material increases the probability of the material being entrapped by a propulsor. But, it is advantageous to keep the volume of material to a minimum so that it can be more easily stored, transported, handled and/or deployed. Chemical composition and physical attributes of exemplary fabric strips are discussed in detail below and numerous examples are provided (see, Examples 2-5, Tables 1-8 and FIGS. 10-13).

It will also be appreciated that the device configurations of FIGS. 4A-4E represent exemplary dry-state geometries, before the device is deployed. It is desirable for the propulsor occlusion materials to quickly expand upon coming into contact with water, and the device geometry will therefore change significantly over time.

In certain embodiments, the propulsor occlusion material must rapidly absorb water to become effective at disabling a vessel within a short time, such as about 10 seconds, about 30 seconds, about 1 minute, about 5 minutes, about 10 minutes, about 15 minutes, about 30 minutes, about 45 minutes, about 1 hour, about 1.5 hours or about 2 hours.

ASTM Active Standard ASTM D570 covers the determination of the relative rate of absorption of water by plastics when immersed. However propulsor occlusion materials cannot be classified strictly as a plastic and because of the unique water-related properties of the materials, ASTM D570 may not be applicable. Accordingly, water absorption rate may be determined by immersing a weighed sample of the material in water for a predetermined time. The sample may then be withdrawn from the water and allowed to drain until no discernable drainage continues. The sample may then be weighed again. This procedure may be repeated until no further change occurs or the sample begins to lose mass.

Composition of the Propulsor Occlusion Devices

As discussed above, the novel propulsor occlusion devices typically comprise one or more strips, pieces or sections of fabric. Each strip may comprise one or more types of fabric and optional additional materials. The fabrics, in turn, are made from any number of fibers, which comprise one or more constituents. As discussed in detail below, exemplary materials may be produced via woven or nonwoven processes, and a number of exemplary materials are disclosed in Examples 1-10 and Tables 1-3 and 5-8.

Unlike typical entanglement devices, the propulsor occlusion fabrics of the embodiments may comprise benign materials that are recognized as generally safe for use ("GRAS"), as defined in 21 C.F.R. 170.30(b), incorporated by reference herein in its entirety. Such materials are non-toxic to humans, invertebrate, fish, and/or phyto plankton. Moreover, the disclosed propulsor occlusion materials may meet all requirements of each of the enumerated laws and regulations in Table 9, below.

Each of the propulsor occlusion components may be dissolvable and/or biodegradable such that they do not cause a significant short-term or long-term impact to the environment. The propulsor occlusion components interact chemically and physically with the water environment into which they are introduced: initially swelling with contact and over a short period of time dispersing.

In one embodiment, the materials may degrade or dissolve by biotic and chemical mechanisms in a matter of hours or days to non-toxic mineralized products. The composition of seawater is not significantly altered from the small mass of added minerals that might occur during the use of the propulsor occlusion devices. Moreover, the buoyant residual materials may be contained in the upper water column (i.e., the infra-littoral zone), where they will not affect reef and benthic environments.

Discharges occurring in the use of propulsor occlusion devices are small in mass and extent. The product may be deployed as a solid polymer of high molecular weight that is significantly insoluble. The amount of propulsor occlusion materials discharged to address discrete engagements is expected to be small and in widely dispersed locations.

In one embodiment, the propulsor occlusion materials may dissolve and/or biodegrade such that will not be a hazard to navigation after about 12 hours. In certain embodiments, the propulsor occlusion material may degrade and/or dissipate into pieces of less than 2 inches in length within about 6 hours, about 12 hours, about 24 hours, about 36 hours, about 48 hours, about 60 hours or within about 72 hours.

The exemplary propulsor occlusion fabrics may maintain a tensile strength capable of stopping and/or slowing a vessel for about 1 hour, about 2 hours, about 5 hours, about 10 hours, about 12 hours, about 24 hours, about 36 hours, or about 48 hours. Once the propulsor occlusion materials dissipate, dissolve and/or degrade to the point that a device is no longer capable of stopping and/or slowing a vessel, the materials will no longer remain a hazard to vessels and/or wildlife.

The diameter of the fibers used to make the fabrics of the engagement device may affect the time it takes for the material to dissipate. The dissolution, or dissipation, rate is dependent on the surface area of the fibers. The surface to volume ratio (S/V) scales as $1/(\Delta L)$ where $\Delta L$ is the change in the length scale. Accordingly, as the fibers become thicker, the time it takes the propulsor occlusion device to dissolve will become longer. Such fibers are discussed in detail below.

The above described method of calculating water absorption may also be used to determine the rate of dissolution of the materials. The mass of a propulsor occlusion material sample may be recorded as a function of time and the dissolution rate may be determined by observation of the mass change with time. The sample is then dried after the measurement is complete and the total change in dry mass is determined.

The dissolution rate may be difficult to measure—measuring the weight loss of the material by removing it from the water is complicated by absorption of water into the material. An alternative approach to determining the dissolution rate comprises looking at the actual dissolved material in the water using either a spectrophotometric technique or nuclear magnetic resonance.

As used herein, material degradation includes a combination of dissolution, dissipation and biodegradation. A number of standard testing procedures may be employed to determine degradation, including but not limited to: ASTM Standard D6691, Standard Test Method for Determining Aerobic Biodegradation of Plastic Materials in the Marine Environment by a Defined Microbial Consortium or Natural Sea Water Inoculum; ASTM Standard D5511, Standard Test Method for Determining Anaerobic Biodegradation of Plastic Materials under High Solids Anaerobic Digestion Conditions; ASTM Standard D7473, Standard Test Method for Weight Attrition of Plastic Materials in the Marine Environment; and ASTM Standard 5988, Standard Test Method for Determining Aerobic Biodegradation of Plastic Materials in Soil. It will be appreciated that the degradation/dissolution rate may be effected by a number of factors, including but not limited to chemical makeup, physical form, water temperature, water salinity and agitation.

The principle components of the inventive propulsor occlusion fibers and fabrics are polyvinyl alcohol (PVA) polymer, polylactic acid (PLA) polymer and/or superabsorbent materials (SAMs), including superabsorbent polymers (SAPs) and superabsorbent fibers (SAFs). The inventive fabrics may be made from fibers comprising one or more of these components according to the processes described below. Such fabrics and/or fibers may also comprise one or more of the following additional, optional ingredients: sodium alginate; multivalent cation and/or anion salts; mineral wool or mineral fibers; thickening agents; fillers; plasticizers; antioxidants; and/or pigments. The precise construct and combination of these constituent materials confer novel and surprising properties when wet.

Typically, the fabrics may comprise from about 10% by weight PVA to about 100% by weight PVA. More typically, the fibers may comprise from about 20% to about 80% by weight PVA.

In certain embodiments, the fabrics may comprise a single PVA constituent. In alternative embodiments, multiple PVA constituents with different properties may be included, each present in any amount. For example, fabrics may comprise 25% by weight of a first PVA and 75% by weight of a second PVA. As another example, fabrics may comprise 50% by weight of a first PVA and 50% by weight of a second PVA.

It will be appreciated that exemplary fabrics may not comprise any amount of PVA. On the other hand, fibers may comprise about 100% by weight PVA.

PVA is a hydrophilic synthetic polymer having the following idealized chemical formula:

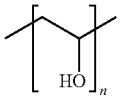

Generally, PVA has excellent film forming, emulsifying and adhesive properties. When dry, PVA has high tensile strength and flexibility, as well as high oxygen barrier properties. Water acts as a plasticizer upon PVA, and the material loses tensile strength, but gains elongation and tear strength when wetted.

PVA is produced commercially from polyvinyl acetate, usually by a continuous process, such as hydrolysis, alcoholysis or saponification. The acetate groups are hydrolyzed by ester interchange with methanol in the presence of anhydrous sodium methylate or aqueous sodium hydroxide. Following gradual addition of the aqueous saponification agent, PVA is precipitated, washed and dried. The degree of hydrolysis is determined by the time the saponification reaction is stopped.

The physical characteristics and specific functional uses of particular PVA polymers depend on the degree of polymerization, the degree of hydrolysis and the molecular weight. PVA is classified into two classes: partially hydrolyzed and fully hydrolyzed.

In the broadest aspect of the embodiments, there is essentially no restriction on the nature of the PVA employed. What is considered important is that the PVA comprises as high a tensile strength as possible, while still biodegrading and/or dissolving in water within a reasonable period of time, and that it is capable of adhering to metal propellers when wet.

PVA polymers that are typically employed may comprise a viscosity of from about 3 to about 35 mPa s; a degree of hydrolysis between about 92 and about 99 mol. %; a pH of from about 4.0 to about 7.0; and/or a melt point of from about 150 to about 210 degrees C. In certain embodiments, PVA polymers may be employed having one or more cross-linking agents.

PVA polymers engineered to have low crystallinity with high hydrogen bond strength are preferred. Such materials may have relatively low melting points, high stretching characteristics and high gas barrier performance, as well as low foaming, aqueous solution stability and emulsification performance.

A number of PVA polymer products have been found to be useful in producing propulsor occlusion fabrics, including but not limited to: NICHIGO G-POLYMER OKS-8041P, produced by Nippon Synthetic Chemical industry Co., Ltd. ("Nippon"); NICHIGO G-POLYMER™ OK-8070P PVA, produced by Nippon; EXCEVAL™ (CP4104) PVA, produced by Kuraray Europe GmbH ("Kuraray"); NICHIGO G-POLYMER™ OK-8071 PVA, produced by Nippon; NICHIGO G-POLYMER™ OK-8112 PVA, produced by Nippon; NICHIGO G-POLYMER™ OK-8042 PVA, produced by Nippon; and MOWIFLEX™ PVA, produced by Kuraray.

The second principal component of the inventive propulsor occlusion composition is polylactic acid (PLA). Typically, the fabrics may comprise from about 10% by weight PLA to about 100% by weight PLA. More typically, the fabrics may comprise from about 20% to about 80% by weight PLA.

In certain embodiments, the fabrics may comprise a single PLA constituent. In alternative embodiments, multiple PLA constituents with different properties may be included, each present in any amount. For example, fabrics (and/or fibers) may comprise 25% by weight of a first PLA material and 75% by weight of a second PLA material. As another example, fabrics may comprise 50% by weight of a first PLA material and 50% by weight of a second PLA material.

It will be appreciated that, in some embodiments, the fabrics may not comprise any amount of PLA. In alternative embodiments, fabrics may comprise about 100% by weight PLA.

Polylactic acid is a biodegradable, high-strength, low-solubility polymer having the following chemical formula:

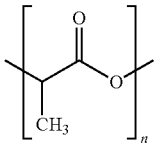

PLA exists as a polymeric helix, with an orthorhombic unit cell. The tensile properties of PLA can vary widely, depending on whether or not it is annealed or oriented or what its degree of crystallinity is. PLA's stereo-chemical makeup is easily controlled by polymerization with D-lactide, D,L-lactide, or meso-lactide, to form random or block stereo-copolymers, while the molecular weight is directly controlled by the addition of hydroxylic compounds (i.e., lactic acid, water, alcohols).

The ability to control the sterochemical architecture allows precise control over the speed and degree of crystallinity, the mechanical properties, and the processing temperatures of the material. For example, although highly crystalline PLA may have a very high tensile strength, it may take months or years to hydrolyze fully to lactic acid, whereas an amorphous sample may be degraded quickly.

In the broadest aspect of the embodiments, there is essentially no restriction on the nature of the PLA employed. What is considered important is: the PLA comprises as high a tensile strength as possible while still being biodegradable within a reasonable period of time; the PLA is capable of adhering to metallic propellers; and the PLA can be processed into the desired or required fabrics and fibers.

Typical PLA polymers may comprise a specific gravity of from about 1 to about 2 (e.g., about 1.25); a relative viscosity of from about 2.5 to about 4.5; a melt index of about 15 to about 3 at 210 C; a melt density of from about 1 to about 2 at 230 C; a glass transition temperature of from about 50 to about 65 C; and a crystalline melt temperature of from about 150 to about 175 C.

A number of PLA polymer products have been found to be useful in producing propulsor occlusion fabrics, including but not limited to INGEO™ 6400D and 6202D, both produced by Nature Works LLC.

In preferred embodiments, the propulsor occlusion fabrics may comprise both PVA and PLA. The fabrics typically comprise a PVA to PLA weight ratio varying from about 9:1 to about 1:9. Exemplary fabrics (and/or fibers) may comprise 90% by weight PVA and 10% by weight PLA; 80% by weight PVA and 20% by weight PLA; 75% by weight PVA and 25% by weight PLA; 70% by weight PVA and 30% by weight PLA; 50% by weight PVA and 50% by weight PLA; 30% by weight PVA and 70% by weight PLA; 25% by weight PVA and 75% by weight PLA; 20% by weight PVA and 80% by weight PLA; or 10% by weight PVA and 90% by weight PLA.

The PVA/PLA fibers may comprise from about 20% to about 35% by weight PVA and from about 65% to about 80% by weight PLA. For example, the PVA/PLA bicomponent fibers discussed in Example 5 comprise 70% by weight PVA and a 30% by weight PLA. These fibers may comprise a core/sheath geometry, with a PLA core and PVA sheath. A number of exemplary PVA/PLA fibers and method for producing the same are disclosed in Examples 1-6 and in Tables 1-9, below.

Preferred for use in the propulsor occlusion compositions of the embodiments are super absorbent polymers. SAPs are water-absorbing polymers that absorb aqueous solutions through hydrogen bonding with water molecules. The chemical compound of SAPs may be shown as:

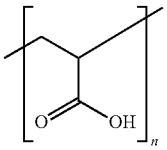

There are many methods to prepare SAPs with various starting materials, such as copolymerizing hydrophilic monomer with a cross-linking agent, grafting monomer with starch, cellulose, synthetic fiber, and polysaccharide, cross-linking linear hydrophilic polymer with polyvalent metal ions or organic multifunctional group materials etc. SAPs can be in the form of small particles, powder, fiber, membrane, microbeads and even liquid.

A SAP's ability to absorb water is a factor of the ionic concentration of the aqueous solution. In deionized and distilled water, a SAP may absorb 300 times its weight (from 30 to 60 times its own volume) and can become up to 99.9% liquid, but when put into a 0.9% saline solution, the absorbency drops to about 50 times its weight. The presence of valence cations in the solution impedes the polymer's ability to bond with the water molecule.

The total absorbency and swelling capacity are controlled by the type and degree of cross-linkers used to make the gel. Low-density, cross-linked SAPs generally have a higher absorbent capacity and swell to a larger degree. These types of SAPs also have a softer and stickier gel formation. High cross-link density polymers exhibit lower absorbent capacity and swell, but the gel strength is firmer and can maintain particle shape even under modest pressure.

SAPs are now commonly made from the polymerization of acrylic acid blended with sodium hydroxide in the presence of an initiator to form a poly-acrylic acid sodium salt ("sodium polyacrylate"). Sodium polyacrylate is an anionic polyelectrolyte with negatively charged carboxylic groups in the main chain.

While sodium neutralized polyacrylic acids are the most common form used in industry, there are also other salts available including potassium, lithium and ammonium. SAPs made from other materials may be employed such as those made from one or more of: polyacrylamide copolymer, ethylene maleic anhydride copolymer, cross-linked carboxymethylcellulose, polyvinyl alcohol copolymers, cross-linked polyethylene oxide, and starch grafted copolymer of polyacrylonitrile to name a few.

Incorporation SAPs into the propulsor occlusion device fabrics may allow for quicker water absorption upon deployment and added volume of the material. Although SAPs generally become weak when saturated with water, their expansion provides a driving force for causing the propulsor occlusion material to "bloom." Accordingly, the effectiveness of the materials may be increased by incorporated SAPs.

The propulsor occlusion fabrics may comprise one or more of the above-described SAPs. For example, granules of SAPs may be adhered to the inventive fibers via any mechanical, thermal or chemical means, or may be extruded with the PVA and/or PLA materials. In certain embodiments, SAP fibers may be created and incorporated into woven and/or nonwoven fabrics via sewing or bonding (i.e., thermal, chemical, mechanical, etc).

In the broadest aspect of the embodiments, there is essentially no restriction on the nature of the SAPs. What is considered important is that a SAP comprises high water absorption, while having as high a tensile strength as possible and while still being biodegradable and/or dissolvable within an acceptable period of time.

In one embodiment, the propulsor occlusion fabrics may comprise an amount of an alginate material, such as sodium alginate, as a stabilizer, thickener, gelling agent, and/or emulsifier. Sodium alginate is a natural polysaccharide from brown seaweed and its empirical formula is $(C_6H_7NaO_6)_n$. This material is a natural product, and is biodegradable.

Sodium alginate dissolves slowly in water, forming a viscous solution. Regions of guluronate monomers ("G-blocks"), in one alginate molecule can be linked to similar region in another alginate molecule by means of calcium ions or other multivalent cations. The divalent calcium cation fits into the G-block structure, binding the alginate polymers together by forming junction zones, resulting in gelation of the solution.

Another valuable property of alginates is that they are soluble in cold water and do not need a heating and cooling cycle to form gels (in the presence of calcium). By selecting an appropriate grade and/or formulation, alginates can be customized so that their gel-forming characteristics facilitate matrix and structural building properties. Moreover, in presence of calcium, the material forms a gel without the need of heat.

An alginate's type, counter-ion, calcium source and the sequestering agent control the gelling system structure and the rate at which gel forms. Hydration and uniform distribution of the alginate are also important to optimize gel formation.

In one embodiment, the propulsor occlusion composition may comprise one or more multivalent cation and/or anion salts, such as but not limited to: sodium borate ("borax"), copper sulfate, sodium sulfate, calcium oxide, aluminum oxide, sodium bicarbonate, alginic acid, citric acid aluminum acetate and the like. Such materials may be employed to increase positive buoyancy through gas production, as well as increase strength, duration, and/or ability of the propulsor occlusion device to adhere to a metallic prop. These materials may crosslink PVA to form a sticky gel having strong adhesion properties.

In certain embodiments, such additives may be included in an amount of from about 0.1% to about 0.6% by weight, from about 0.2% to about 0.5% by weight, or from about 0.3% to about 0.4% by weight. In one particular embodiment, about 0.3% by weight borax may be included.

The fabrics may also comprise an amount of citric acid and sodium bicarbonate. The combination of citric acid and sodium bicarbonate may be employed to create $CO_2$ for buoyancy. This combination may be included in the same fibers, or may be added to different fibers that are combined to form a fabric. Creating two fibers of different polymers side-by-side offers the possibility of creating $CO_2$ over a period of time (e.g., about 10 to about 20 minutes) directly from the fiber when exposed to water. This may eliminate or reduce the need for the buoyancy bags, discussed in detail below. Various concentrations of these additives may be combined with PVA, PLA and/or SAP solutions and extruded into fibers using, the below described methods (e.g., using a dry spinning extruder).

In another embodiment, the fabrics may include an amount of beeswax. The combination of borax and beeswax may be employed to create an emulsion.

In one embodiment, the fabrics may comprise one or more plasticizers. Exemplary plasticizers include, but are not limited to acetylated monoglyceride, alkyl citrates and/or epoxidized soybean oil (ESBO).

In another embodiment, the fabrics may comprise one or more antioxidants. Such antioxidants may prevent oxidative degradation of the propulsor occlusion products during storage that would otherwise cause a loss of strength. Exemplary antioxidants include, but are not limited to, natural antioxidants such as ascorbic acid and tocopherols; and synthetic antioxidants such as propylgallate, tertiary butylhydroquinone, butylated hydroxyanisole and butylated hydroxytoluene.

In yet another embodiment, the fabrics may comprise an amount of mineral wool or mineral fibers. Such materials are formed by spinning or drawing molten minerals such as basalt. Mineral fibers may be engineered to hold large amounts of water, and so may be employed to increase water absorption of the fabric.

Optionally, other ingredients may be incorporated into a spinnable composition from which a fabric is made. Such optional materials may be used to modify the processability and/or performance characteristics, such as opacity, elasticity, tensile strength, wet strength, and modulus of the final product. Other benefits include, but are not limited to, stability, including oxidative stability, brightness, color, flexibility, resiliency, workability, processing aids, viscosity modifiers, and odor control. Examples of optional materials include, but are not limited to, filler(s) such as quartz, calcite, clay, talc, barite, and/or NA-AL-silicate, and the like; pigments like titanium dioxide, lithopone and other inorganic pigments; dispersants such as polyphosphates, polyacrylates, phosphonates, napthene and lignin sulfonates, to name a few; wetting agents, including anionic, cationic, amphoteric and/or non-ionic surfactants; defoamers such as, for example, silicon emulsions, hydrocarbons and long-chain alcohols; stabilizers, including for example mostly cationic compounds; coalescing agents including, without limitation, alkali-stable esters, glycols, and hydrocarbons; rheological additives like cellulose derivatives (e.g., carboxymethylcellulose and/or hydroxyethylcellulose), xanthan gum, polyurethane, polyacrylate, modified starch, bentone and other lamellar silicates; water repellents such as alkyl siliconates, siloxanes, wax emulsions, fatty acid Li salts; and conventional fungicide or biocide.

Manufacturing Fibers & Fabrics

Figure 5A:
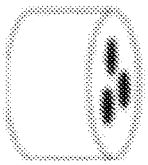
FIGS. 5A-5N, show exemplary cross-sections of mono- and multicomponent fibers useful for creating a number of exemplary propulsor occlusion device fabrics.
Figure 5B:
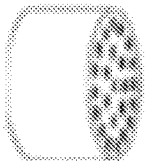
Figure 5C:
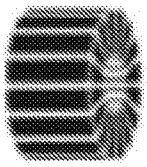
Figure 5D:
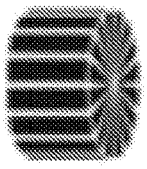
Figure 5E:
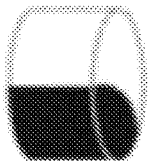
Figure 5F:
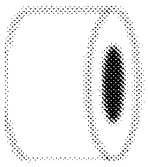
Figure 5G:
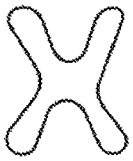
Figure 5H:
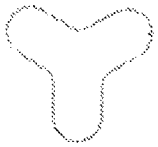
Figure 5I:
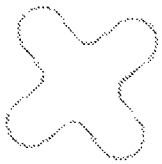
Figure 5J:
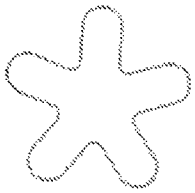
Figure 5K:
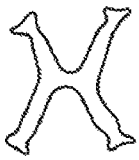
Figure 5L:
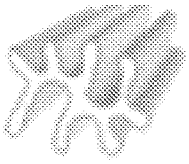
Figure 5M:
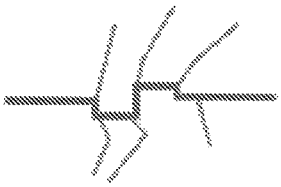
Figure 5N:
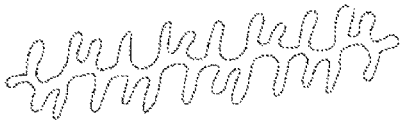

Referring to FIGS. 5A-5N, cross-sections of a number of acceptable fiber geometries are illustrated. The mono and multiconstituent fibers of the present embodiments comprise the above-described materials and may be in many different configurations.

Exemplary extruded fibers can have virtually any transverse cross-sectional shape, including, but not limited to: x-shaped (FIG. 5I), elongated x-shaped (FIG. 5G), cross shaped (FIG. 5K), Y-shaped (FIG. 5H), star shaped (FIG. 5J), round, elliptical, ribbon shaped, dog bone shaped, and other multilobal cross-sectional shapes. Multilobal fibers worth mentioning include, but are not limited to solid or hollow: octolobal (FIG. 5L), starfish (FIG. 5M), caterpillar (FIG. 5N), trilobal, delta shaped, square, star or elliptical fibers.

The mono or multiconstituent fibers may also be multicomponent in configuration. A "component," may be defined as a separate part of a particular fiber that has a spatial relationship to another part of the fiber. The main objective of producing multicomponent fibers is to exploit capabilities not existing in any single component alone.

Multicomponent fibers according to an embodiments, may be in any cross sectional shape or geometry, such as but not limited to, a side-by-side (FIG. 5E), sheath-core (FIG. 5F), sheath-sheath-core, segmented pie (FIG. 5D), hollow pie wedge (FIG. 5C), three island (FIG. 5A) or island-in-the-sea (FIG. 5B) configurations. Alternatively, the multicomponent fibers may be mixed homo or single component fibers. The sheath of any fiber may be non-continuous or continuous around the core. If present, a hollow region in the fiber may be singular in number or multiple. The hollow region may be produced by a spinneret design or possibly by dissolving out a water-soluble component such as PVA.

Generally, the fabrics of the embodiments may be produced by combining the above-described fibers and any optional additional components into fabrics via any number of woven or nonwoven processes. Nonwoven fabrics are broadly defined as sheet or web structures bonded together by entangling or interlocking fiber or filaments mechanically, thermally or chemically. They are flat or tufted porous sheets that are made directly from separate fibers, molten plastic or plastic film. They are not made by weaving or knitting and do not require converting the fibers to yarn. However, woven fabrics may be combined with non-woven fabrics via one of the below described bonding processes.

An exemplary nonwoven process begins with converting the PVA, PLA and/or SAM polymer(s) being spun into a fluid state. If the polymer is a thermoplastic then it can be simply melted, otherwise it is dissolved in a solvent or chemically treated to form soluble or thermoplastic derivatives. Any of the optional additives discussed above may be spun with the polymer(s) or may be added after spinning.

The molten polymer(s) is then forced through a spinneret to form a desired fiber shape and the resulting web is allowed to cool to a rubbery state and then a solidified state. If a polymer solution is used, then the solvent is removed after being forced through the spinneret.

Generally, any spinning process may be employed to create the initial web. For example, wet, dry, dry jet-wet, melt (extrusion, direct, etc.), gel and/or electrospinning spinning techniques may be employed.

In one embodiment, dry spinning may be employed. The polymers are dissolved in a solvent, and solidification may be achieved through evaporation of the solvent. Evaporation may be achieved via a stream of air or inert gas. Because there is no precipitating liquid involved, the fiber does not need to be dried, and the solvent is more easily recovered.

In another embodiment, melt spinning is employed for forming the mixed filament products described herein. For example, bicomponent spinning involves the extrusion of two different types of the same polymer or two different polymers through a spinneret, respectively.

A number of spinning techniques for multicomponent and/or multiconstituent spinning of PVA, PLA and/or SAP materials may be employed to produce the fibers. The following discussion is framed in terms of bicomponent spinning, however it relates to any number of components and/or constituents.

One method of manufacturing bicomponent fibers is the side-by-side extrusion of two polymers through one spinneret hole. As the two polymers cool and solidify they adhere together as one filament. The filament is composed of both the fibers.

Another means of manufacture of bicomponent fiber is that of using one spinneret inside another. A first polymer is pumped through a center or core spinneret while a second is pumped though an outer or surrounding spinneret. Both polymers emerge as one through the common hole of the surrounding spinneret so that the fiber is formed of a core of one polymer surrounded by a sheath or ring of another.

The third method of producing bicomponent fiber is the distribution of drops of a first molten polymer into a second molten polymer. This composite mixture is then extruded through a single spinneret hole. The result is a matrix or conglomerate, of minute short strands of one fiber suspended inside another.

Whatever spinning process is applied, the fibers are then attenuated and collected (i.e., drawn) to increase strength and orientation. This may be done while the polymer is still in the process of solidifying or after it has completely cooled down. Drawing pulls the molecular chains together and orients them along the fiber axis, resulting in a stronger web.

The web fibers are then combined or bonded together using at least one of heat, pressure, a chemical binder, mechanical entanglement, hydraulic entanglement, and combinations thereof resulting in the formation of a nonwoven fibrous fabric.

Thermal bonding may include the use of a heat sealer, a large oven for curing, and/or calendaring through heated rollers. In one preferred process, the nonwoven fabrics may be prepared using a spunbond method that employs calendaring through heated rollers ("calendars"). The calendars can be smooth faced for an overall bond or patterned for a softer, more tear resistant bond.

In one embodiment, chemical bonding, or a wetlaid processes, may be employed. Such process includes the use of binders to chemically join the fibers. In one embodiment, binder fibers or powders may be melted to hold non-melting fibers together. In another example, sodium hydroxide or the like may be employed to shrink bond the fibers.

In another embodiment, a melt-blown process may be employed where fiber is bonded as air attenuated fibers intertangle with themselves during simultaneous fiber and web formation. In one example, a spunbond process may be combined with a melt-blown binding process to produce a spun-melt-spun layered product.

In another embodiment, mechanical bonding, such as needle-punching, may be employed. Generally, mechanical bonding comprises penetrating the web with an array of barbed needles that carry tufts of the web's own fibers into a vertical direction through the web. A controlled ratio of low melt fiber may be incorporated into a base nonwoven fabric by heating the material enough to soften it to the point that it binds to the main fibers where those fibers intersect, thereby locking the fibers together.

The propulsor occlusion materials formed in accordance with the present embodiments may comprise a single layer of bonded fabric, but typically comprise a number of layers. As used herein, a "layer" is part of a fibrous fabric that is produced in a separate fiber laydown or forming step and will typically have the same combination of fibers and any additive materials intimately mixed throughout the layer. It will be appreciated that a single layer may have a combination of different fiber shapes, diameters, configurations, and compositions.

The layers may be consolidated by thermal point-bonding or any other of the above described bonding techniques to attain strength, integrity and certain aesthetic characteristics. The single layer of shaped fibers of the present embodiments may be utilized by itself as a propulsor occlusion fabric, or the layer may be combined with other nonwoven layers or a film layer to produce a laminate. As used herein, a "laminate" is defined as a two or more layers contacting along at least a portion of their respective planar faces with or without interfacial mixing.

Exemplary equipment that can be used to produce any of the inventive fibers and fabrics is described in US Patent Application Pub. No. 2006/0012072 to Hagewood et al., incorporated by reference herein in its entirety. Exemplary equipment includes the following main parts: (1) Extruders and/or melt pumps to melt, mix and meter the polymer component, (2) a spin pack system or assembly comprising a polymer melt distribution system and spinneret that delivers a polymer melt(s) to capillaries that have shaped orifices, (3) attenuation device driven by pneumatic air, positive pressure, direct force and/or vacuum by which air drag forces act on a polymer stream to attenuate the fiber diameter to smaller than the orifice overall geometric shape, (4) fiber laydown region where fibers are collected underneath the attenuation device in a random orientation, and (5) fiber bonding system that prevents long range collective fiber movement. Numerous companies manufacture fiber and fabric making technologies that can be used for the present embodiments, and some non limiting examples include Hills Inc., Reifenhauser GmbH, Rieter Corporation, Neumag GmbH, Nordson Fiber Systems and others.

Figure 6:
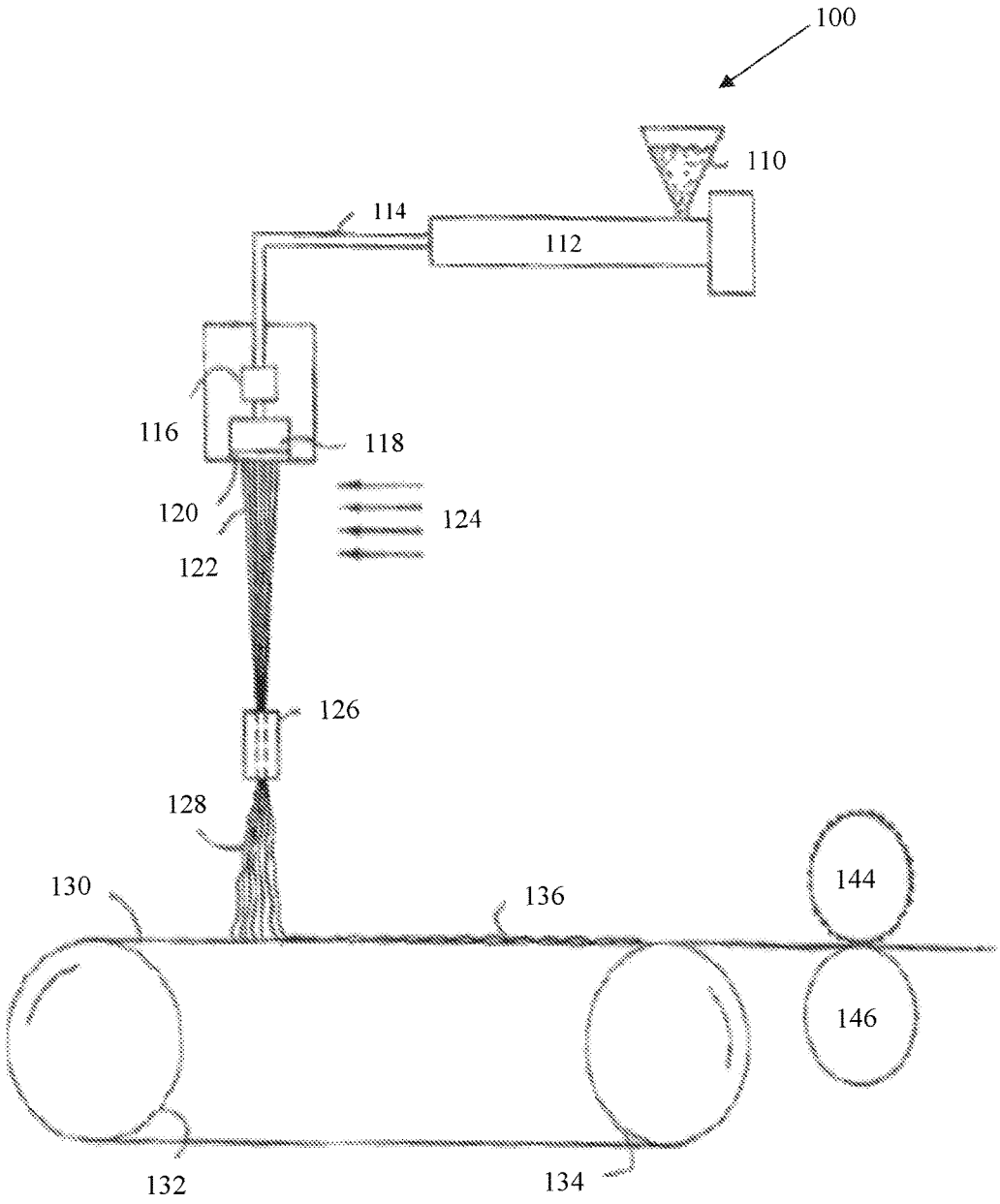
FIG. 6 shows a schematic of an exemplary spunbond line 100 that may be employed to create any number of nonwoven propulsor occlusion device fabrics.

Referring to FIG. 6, a schematic of a typical spunbond system 100 utilizing a single polymer source is shown. Briefly, an exemplary spunbond system may include a hopper 110 into which pellets of polymer are placed. The polymer is fed from hopper 110 to a screw extruder 112, where the polymer is melted. The molten polymer flows through heated pipe 114 into metering pump 116 and spin pack assembly 118, including a spinneret 120 with orifices through which fibers 122 are extruded. The extruded fibers 122 are quenched with a quenching medium 124 (e.g., air), and are subsequently directed into a drawing unit 126 (e.g., aspirator). Upon exiting the drawing unit 126, the attenuated fibers 128 are laid down upon a continuous screen belt 130 supported and driven by rolls 132 and 134. The screen belt conveys the prebonded web of fibers from the laydown location to calendar rolls 144 and 146. The extruder and melt pumps are chosen based on the polymers desired. Finally, the produced fabric may be introduced to a winder (not shown) to create rolls that may be transported.

It will be appreciated that the above-described optional materials my be incorporated into PVA and/or PLA fabrics by adding the material to the initial spinning step or by bonding the material to one or more fabric layers. As an example, SAP granules may be extruded with, or bonded to, PVA/PLA fibers. In one particular embodiment, SAP fibers may be created and then either (1) sewn into woven PVA/PLA fabrics or (2) crimped, cut to staple length, carded and needle punch formed into nonwoven fabrics.

Nonwoven fabrics may be post-processed in order to be used as a propulsor occlusion device. Post-processing may comprise one or more of: cutting and/or shaping fibers into predetermined lengths, cutting apertures into the fabric, and/or incorporating strength members therein. Strength members may be incorporated into fabrics by sewing or heat fusing the material.

It will be appreciated that although a nonwoven process is described above, any woven process may alternatively or additionally be employed to produce the inventive fabrics. Weaving has the advantage of easily adding in materials for particular functionality. For example, a fill yarn comprising any of the above-described materials may be created and weaved into a particular fabric. Moreover, any fiber construct can be fabricated by laminating sheets of woven materials together and/or laminating a woven fiber with a nonwoven fiber. An exemplary woven process is discussed in detail below in Example 2.

Deployment & Buoyancy Control

The disclosed propulsor occlusion devices may be deployed in any number of ways, including in, on, or above water. For example, the device may be deployed by a diver or underwater vehicle. As another example, the device may be deployed via a seagoing vessel, such as by dropping, throwing or launching. As yet another example, the device may be dropped or launched via manned or unmanned aircraft. Upon deployment, the total density of the wetted material should be at or just slightly below the density of water if it is to remain on or within close proximity of the surface.

When the propulsor occlusion material is deployed from below the water, it must float to a position at or just slightly below the surface of the water. Providing a pre-constructed, fixed volume of material for flotation greatly increases the amount of ballast required to initially submerge the containment system prior to deployment. Accordingly, having a compact, inflatable source of buoyancy would help to minimize the pre-deployment volume necessary to submerge.

The disclosed fabrics may have a negative buoyancy (not including entrapped air), and so a deployment apparatus may be employed to provide beneficial positive buoyancy. In certain embodiments, the propulsor occlusion materials may comprise one or more materials and/or be shaped in such a way as to be provided with a controlled buoyancy.

Figure 7:
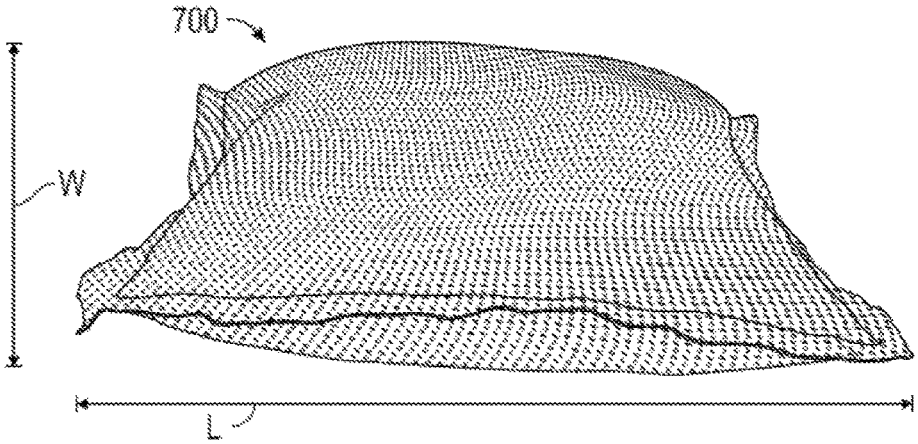
FIG. 7 shows an exemplary buoyancy bag 700 according to an embodiment.

Referring to FIG. 7, an exemplary inflatable buoyancy bag 700 is illustrated. The buoyancy bag may comprises a number of components that generate one or more gasses (e.g., carbon dioxide) upon submersion in water.

It has surprisingly been found that spun bond materials made from certain PVA polymers, such as EXCEVAL™ (CP4104) PVA, produced by Kuraray Europe GmbH, are gas permeable when dry, but quickly become gas impermeable when hydrated. This phenomenon may be exploited to employ an inflatable bag assembly to provide flotation.

Rectangular-shaped bags having a length (L) longer than their width (W) were sewn. The maximum internal volume of an exemplary bag is approximated by equation 1.

$$V=W^2*L/\pi \tag{1}$$

This assumes a cylinder of length L and cross sectional area W2/π, no loss of volume due to the seams, etc., and represents a maximum. The longer the cylinder, the closer this will be to the actual volume.

In order to generate gas to fill the "cylinder" an aqueous reaction of sodium bicarbonate ($NaHCO_3$) and citric acid ($C_6H_8O_7$) may be employed to generate carbon dioxide ($CO_2$). The chemicals react according to equation 2 (ignoring additional ions in solution).

$$3\ NaHCO_{3(aq)}+C_6H_8O_{7(aq)}\rightarrow CO_{2(g)}+H_2O+Na_3C_6H_5O_{7(aq)} \tag{2}$$

Since the $CO_2$ is lost to the solution as a gas, the reaction is driven to the right. Given the molecular weights of the reactants and the stoichiometry of 3 moles of $NaHCO_3$ reacting with one mole of $C_6H_8O_7$ to produce one mole of $CO_2$, one gram of $NaHCO_3$ should react with 0.76 grams of $C_6H_8O_7$ to yield 0.52 grams (0.0119 moles) of $CO_2$. Under expected conditions (e.g., 30 feet or less in depth, maximum 2 atm, and water temperature of 20° C.) the $CO_2$ gas produced should approximately follow the ideal gas law (equation 3).

$$P*V=n*R*T \tag{3}$$

Under these conditions, with a 1:1 (w/w) ratio of bicarbonate to citric acid (20% excess by weight of citric acid), one gram of bicarbonate will produce 143 $cm^3$ of gas. Assuming an approximate water density of 1 $g/cm^3$ the $CO_2$ produced should provide the equivalent of 143 g buoyant force (note that buoyancy should be measured in force, however, gravity can be cancelled out).

As an example, a bag may comprise dimensions of 4 inches by 8 inches (10 cm by 20 cm). This would have a theoretical volume of 637 $cm^3$ and provide flotation for 637 grams or 1.4 pounds, and measurements agreed with such predictions (about 1.5 pounds). The amount of bicarbonate required to fill this volume of gas would be 4.45 grams.

In practice, bags were fabricated in a production line mode. Citric acid and sodium bicarbonate were premixed in equal amounts and 10 grams of the mixture was added to each bag. The bags retained buoyancy for several hours before sinking (most likely due to slow gas permeability of the wetted fabric).

Figure 8:
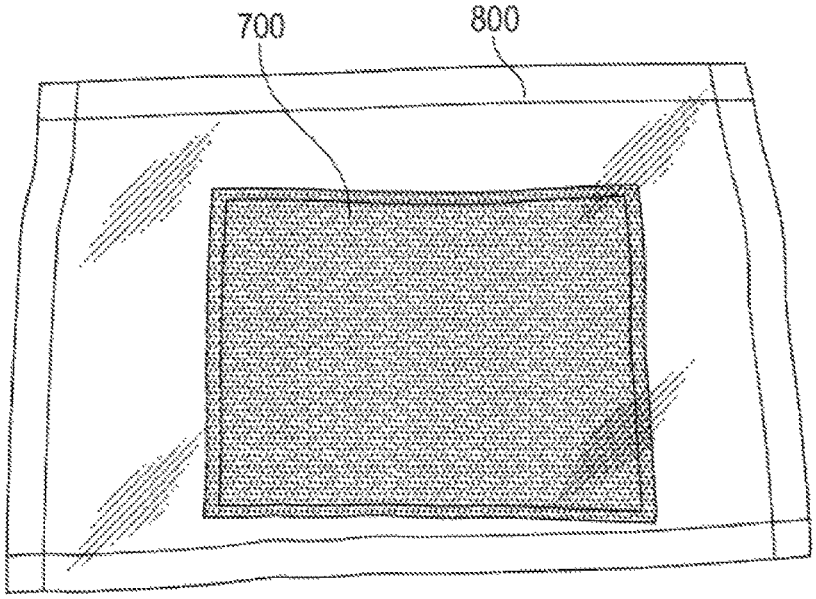
FIG. 8 shows an exemplary packaging that may be employed to house the buoyancy bag 700 of FIG. 7 prior to deployment.

In field tests it was noted that bags filled with SAPs also seemed to provide flotation. Laboratory attempts were undertaken to replicate this observation. A bag was fabricated as described above, and 2.89 g of SAF was placed in the bag instead of the citric acid/sodium bicarbonate mixture. As shown in FIG. 8, the bag 700 was sealed in a food-saver vacuum bag 800. The vacuum bag 800 was then opened under water and the SAF was allowed to absorb water for about one minute. The bag "inflated" and was neutrally buoyant.

Self Assembling 3D Structure & Shape

A factor in the probability of intercept of a propulsor occlusion composition is the extension/expansion of the material in the water column. The material needs to be compact prior to deployment, but must expand quickly after deployment.

It was observed that the use of superabsorbent materials (SAMs), including SAPs and SAFs, caused the propulsor occlusion materials to "bloom" in the water due to a rapid increase in volume of the SAM upon wetting. SAMs absorb many times their mass in water a result of osmotic pressure.

As shown in Example 9 below, OASIS SAF® 6032 sliver from Technical Absorbents, Inc. was investigated. This material comprises a 50:50 weight ratio of SAF to polyethylene terephthalate (PET). It was found that, as the SAF absorbs water, the material expands and the fibers of PET were separated. Unfortunately as previously discussed, the swollen SAF fibers became weak and under the pressure from a propeller, the SAF sloughed off.

Just as a balloon assumes a particular shape when inflated, the osmotic pressure of the SAF or the pneumatic pressure of carbon dioxide formation may be used to cause a propulsor occlusion assembly to assume a shape in the water.

The hoop stress is the force tangent to the cylinder and perpendicular to the radius, $\sigma\Theta$. The stress along the axis of the cylinder is the longitudinal stress, $\sigma Z$. The approximate magnitude of these stresses is given by equations 4 and 5, where P is the internal pressure, r is the radius of the cylinder and t is the thickness of the wall.

$$\sigma\theta = Pr/t \quad (4)$$

$$\sigma z = Pr/2t \quad (5)$$

Comparing two cylinders made of the same material (wall thickness) one can see that the stress on the surface, the restoring force, is proportional to the radius. That is, at the same pressure, a larger cylinder will have more force to make it assume a fully extended shape. The force is also proportional to the pressure, so, as is intuitively obvious, higher pressure will exert more force to assume an extended shape.

With the buoyancy bags that were previously described, the internal pressure depends on the amount of gas producing material added. The osmotic pressure will increase until the containment of the bag forces it to stop.

When a cylinder is rolled up, it may be more difficult for it to unroll than if it is folded into an accordion shape. Accordingly, it is possible to use pneumatic and/or osmotic forces to attain an expanded shape.

Referring to FIG. 8, an exemplary vacuum packing material 800 for use in limiting the pre-deployment volume of the propulsor occlusion device is shown. As discussed above, the volume of the propulsor occlusion device before deployment should be minimized. Moreover, in some situations, such as when deployed via a diver, the device may need to be submerged for deployment but not in intimate contact with the aqueous media prior to engagement.

Accordingly, a vacuum packing material 800 may be employed to contain the device before use. Such packing material may comprise any material having desired or required properties. Exemplary materials include, but are not limited to water-soluble PVA, polypropylenes and other packaging materials. Such packaging can be made strong enough to contain the volume of the propulsor occlusion materials when dry, while dissolving within a predetermined period of time within coming in contact with water to allow the propulsor occlusion device to quickly absorb water.

Such packaging imparts a number of benefits. First, it minimizes the volume and allows pre-deployed propulsor occlusion devices to be more easily handled. Second, if the mechanism for deployment is air drop or gun, the denser packing of the material will make it more aerodynamic. Third, it has surprisingly been found that removing air from between the fibers of the propulsor occlusion device allows more rapid ingress of water into the fabric.

EXAMPLES

The below terms are used throughout the Examples and are defined as follows:

- "PVA A" refers to NICHIGO G-POLYMER OKS-8041P, produced by Nippon Synthetic Chemical Industry Co., Ltd. ("Nippon")
- "PVA B" refers to NICHIGO G-POLYMER™ OK-8070P PVA, produced by Nippon.
- "PVA C" refers to EXCEVAL™ (CP4104) PVA, produced by Kuraray Europe GmbH ("Kuraray").
- "PVA D" refers to NICHIGO G-POLYMER™ OK-8071 PVA, produced by Nippon.
- "PVA E" refers to NICHIGO G-POLYMER™ OK-8112 PVA, produced by Nippon.
- "PVA F" refers to NICHIGO G-POLYMER™ OK-8042 PVA, produced by Nippon.
- "PVA G" refers to MOWIFLEX™ PVA, produced by Kuraray.
- "PLA A" refers to INGEO™ Biopolymer 6400D, produced by Nature Works LLC.
- "PLA B" refers to INGEO™ Biopolymer 6202D, produced by Nature Works LLC.
- "PEO" refers to Polyethylene

Example 1—Multiple Yarn Samples

As shown in Table 1, below, a number of fibers were extruded and tested at Clemson University. As shown, each of the mono and/or multiconstituent samples comprises a number of single or multi-component fibers (Component 1, Component 2) having one of any number of cross-sectional geometries (e.g., round, segmented pie, caterpillar, starfish, octopus, hollow, core/sheath). Also noted in Table 1 is the yarn denier (gpd) and measurements of the tensile strength (kgf) and elongation of the yarn/fiber type produced in the extrusion process as well as detail and explanation of the experimental rationale for producing the various materials. As discussed below, a number of the samples were further processed into fabrics via woven and nonwoven processes.

TABLE 1

Preliminary Yarns & Fibers

| Run | Comp. 1 | Comp. 2 | Shape | den (gpd) | FILA (#) | ELONG (%) | STR (kgf) | Notes |
|---|---|---|---|---|---|---|---|---|
| 1 | PVA A | — | | 3421 | 1 | 1.252 | 0.494 | To establish the ability to spin PVA and maximize the denier. Quenched in hexane |
| 2 | PVA A | — | | 4817 | 1 | 3.124 | 2.705 | Increased denier and eliminated quench to increase denier and tenacity |
| 3 | PVA A | — | | 5872 | 1 | 2.534 | 2.715 | Decreased length from spinneret to winder |
| 4 | PVA A | PLA A | Seg. Pie | 684 | 19 | 2.950 | 0.218 | Determined feasibility of spinning PLA/PVA segmented pie ("Seg. Pie") geometries |
| 5 | PVA B | PLA A | Seg. Pie | 733 | 19 | 267.3 | 0.309 | Increased strength by using high MW PVA |
| 6 | PVA B | — | CAT | 12425 | 1 | 351.2 | 1.582 | Caterpillar ("CAT") shape. Maximize adhesion and denier, also high MW PVA drastically increased elongation |
| 7 | PVA B | — | | 70087 | 1 | 349.6 | 18.690 | To increase denier the sample was collected by free fall and not wound |
| 8 | PVA B | — | STAR | 12134 | 1 | 270.3 | 1.941 | Determine strength and self-adhesion of starfish ("STAR") geometry |
| 9 | PVA B | — | CAT | 31969 | 1 | 432 | 5.604 | Caterpillar PVA was collected as free-fall to maximize denier |
| 10 | PVA B | — | CAT | 4455 | 1 | 295.2 | 1.278 | Caterpillar PVA was collected at draw rate 0.4 to assess strength scaling |
| 11 | PVA B | — | CAT | 2705 | 1 | 187.7 | 1.139 | Caterpillar PVA was collected at draw rate 0.8 to assess strength scaling |
| 12 | PVA B | — | CAT | 3104 | 2 | 109.6 | 0.689 | Caterpillar PVA was collected at draw rate 1.6 to assess strength scaling |
| 13a | PLA A | — | | 3286 | 1 | 9.576 | 1.501 | Pure racemic PLA to assess strength for future applications |
| 14 | 5% Alginate | 10% CaCl2 bath | | 6197 | 1 | 1.890 | 1.500 | |
| 15 | 25% PVA A | 75% PVA B | CAT | 3579 | 1 | 307.6 | 0.276 | PVA was collected at draw rate 0.8 to assess strength scaling |

TABLE 1-continued

Preliminary Yarns & Fibers

| Run | Comp. 1 | Comp. 2 | Shape | den (gpd) | FILA (#) | ELONG (%) | STR (kgf) | Notes |
|---|---|---|---|---|---|---|---|---|
| 16 | 25% PVA A | 75% PVA B | CAT | 5753 | 1 | 391.8 | 0.903 | Caterpillar PVA was collected at draw rate 0.4 to assess strength scaling |
| 17 | 25% PVA A | 75% PVA B | CAT | 10086 | 1 | 363.6 | 1.756 | Caterpillar PVA was collected at draw rate 0.2 to assess strength scaling |
| 18 | 25% PVA A | 75% PVA B | CAT | 44189 | 1 | 3.163 | 11.989 | Caterpillar PVA in free fall was collected to assess strength scaling |
| 18a | 25% PVA A | 75% PVA B | CAT | 44309 | 1 | 622.500 | 9.096 | Sample #18 was reanalyzed a day later to ascertain tensile effects of moisture gain |
| 19 | 50% PVA A | 50% PVA B | CAT | 12311 | 1 | 6.562 | 5.261 | Caterpillar PVA was collected at draw rate 0.2 to assess strength scaling |
| 19a | 50% PVA A | — | CAT | 11486 | 1 | 309.5 | 0.749 | Sample #19 was reanalyzed a day later to ascertain tensile effects of moisture gain |
| 20 | 50% PVA A | — | CAT | 5920 | 1 | 57.880 | 1.423 | Caterpillar PVA was collected at draw rate 0.4 to assess strength scaling |
| 20a | 50% PVA A | — | CAT | 7407 | 1 | 211.700 | 1.383 | Sample #20 was reanalyzed a day later to ascertain tensile effects of moisture gain |
| 21 | 50% PVA A | — | CAT | 2771 | 1 | 129.8 | 0.374 | Caterpillar PVA was collected at draw rate 0.8 to assess strength scaling |
| 22 | 50% PVA A | — | CAT | 36567 | 1 | 6.883 | 15.208 | Caterpillar PVA in free fall was collected to assess strength scaling |
| 22a | 50% PVA A | — | CAT | 60325 | 1 | 6.071 | 21.571 | Sample #22 was used to test the affect the moisture on the tensile properties. |
| 22b | 50% PVA A | — | CAT | 45072 | 1 | 6.265 | 13.925 | Sample #22 was used to test the affect the moisture on the tensile properties. |
| 22c | 50% PVA A | — | CAT | 47938 | 1 | 7.247 | 11.338 | Sample #22 was used to test the affect the moisture on the tensile properties. |
| 22d | 50% PVA A | — | CAT | 60621 | 1 | 337.287 | 9.736 | Sample #22 was used to test the affect the moisture on the tensile properties. |
| 22e | 50% PVA A | — | CAT | 54342 | 1 | 446.608 | 4.379 | Sample #22 was used to test the affect the moisture on the tensile properties. |

TABLE 1-continued

Preliminary Yarns & Fibers

| Run | Comp. 1 | Comp. 2 | Shape | den (gpd) | FILA (#) | ELONG (%) | STR (kgf) | Notes |
|---|---|---|---|---|---|---|---|---|
| 23 | PVA A | — | CAT | 3676 | 1 | 127.2 | 0.783 | Caterpillar PVA was collected at draw rate 0.8 to assess strength scaling |
| 23a | PVA A | — | CAT | 2967 | 1 | 87 | 0.404 | Sample #23 was reanalyzed a day later to ascertain tensile effects of moisture gain |
| 24 | PVA A | — | CAT | 5490 | 1 | 69.427 | 1.132 | Caterpillar PVA was collected at draw rate 0.4 to assess strength scaling |
| 25 | PVA A | — | CAT | 93795 | 1 | 46.076 | 6.010 | Caterpillar PVA in free fall was collected to assess strength scaling |
| 26 | 75% PVA A | 25% PVA B | CAT | 2038 | 1 | 179.282 | 0.299 | Caterpillar PVA was collected at draw rate 1.6 to assess strength scaling |
| 27 | 75% PVA A | 25% PVA B | CAT | 3140 | 1 | 132.927 | 0.246 | Caterpillar PVA was collected at draw rate 0.8 to assess strength scaling |
| 28 | 75% PVA A | 25% PVA B | CAT | 7309 | 1 | 168.698 | 0.684 | Caterpillar PVA was collected at draw rate 0.4 to assess strength scaling |
| 29 | 75% PVA A | 25% PVA B | CAT | 9056 | 1 | 75.531 | 1.426 | Caterpillar PVA was collected at draw rate 0.2 to assess strength scaling |
| 30 | 75% PVA A | 25% PVA B | CAT | 72398 | 1 | 89.899 | 4.708 | Caterpillar PVA in free fall was collected to assess strength scaling |
| 31 | PVA B | | | 1053 | 30 | 209.762 | 0.652 | High MW PVA was extruded with the #30 filament spinneret to potentially be made into a "rope" |
| 32 | 5% Alginate | 10% CaCl2 bath | Round | 1503 | 100 | 11.3 | 0.198 | Alginate was spun into many filaments for potential rope. |
| 33 | 5% Alginate | 10% CaCl2 bath | Round | 1604 | 1 | 20.817 | 1.126 | Alginate was spun as a larger round fiber for potential rope use. |
| 34 | 5% Alginate | 10% CaCl2 bath | Round | 1314 | 1 | 12.400 | 1.124 | |
| 35 | PVA B | | STAR | 14355 | 1 | 429.048 | 1.989 | PVA spun using starfish and free fall to replicate a large amount similar to sample #9. |
| 36 | PVA B | OCTO | 7651 | | 1 | 454.872 | 2.001 | PVA spun using octopus ("OCTO") and free fall to produce a large amount similar to sample #9 |
| 37 | PVA B | | OCTO | 10864 | 1 | 368.520 | 2.148 | PVA spun using octopus and free fall to produce a large amount similar to sample #9 |

TABLE 1-continued

| Preliminary Yarns & Fibers | | | | | | | | |
|---|---|---|---|---|---|---|---|---|
| Run | Comp. 1 | Comp. 2 | Shape | den (gpd) | FILA (#) | ELONG (%) | STR (kgf) | Notes |
| 38 | PVA B | | Hollow | 9671 | 1 | 408.948 | 3.370 | Hollow fiber PVA spun to produce a fiber with positive buoyancy in a 3D construct application. |
| 39 | | | | | | | | |
| 40 | PVA B | PLA A | S/C | 755.1 | 19 | 730.021 | 0.198 | First attempt at spinning a bicomponent ("bico") sheath/core ("S/C") fiber with PVA core and thin PLA sheath. |
| 41 | PVA B | | Round | 1111 | 30 | 66.463 | 0.919 | Respun round PVA fiber since first roll was not usable. |
| 42 | PVA B | PLA A | S/C | 844.2 | 19 | 872.913 | 0.152 | Spun bico PLA/PVA sheath/core fiber at a ratio of 5:15 sheath to core. |
| 43 | PVA B | PLA A | S/C | 1054 | 19 | 491.490 | 0.216 | Spun bico PLA/PVA sheath/core fiber at a ratio of 3:17 sheath to core. |
| 44 | PVA B | PLA A | S/C | 1275 | 19 | 326.000 | 0.512 | Large bico PLA/PVA sheath/core fiber at a ratio of 5:30 sheath to core. |
| 45 | PVA B | PLA A | S/C | 1352 | 19 | 356.400 | 0.501 | Large bico PLA/PVA sheath/core fiber at a ratio of 10:30 sheath to core. |
| 46 | PVA B | PLA A | S/C | 327 | 19 | 26.000 | 0.528 | Lower PVA content with multiple PLA ratios, 20:10, 4:1 draw ratio |
| 47 | PVA B | PLA A | S/C | 320 | 19 | 30.100 | 0.502 | Lower PVA content with multiple PLA ratios, 20:8, 4:1 draw ratio |
| 48 | PVA B | PLA A | S/C | 320 | 19 | 33.900 | 0.475 | Lower PVA content with multiple PLA ratios, 20:6, 4:1 draw ratio |
| 49 | PVA B | PLA A | S/C | 665 | 19 | 105.600 | 0.523 | Lower PVA content with varied draw ratios PLA ratios, 20:10, 2:1 draw ratio |
| 50 | PVA B | PLA A | S/C | 410 | 19 | 58.400 | 0.645 | Lower PVA content with varied draw ratios PLA ratios, 20:10, 3:1 draw ratio |
| 51 | PVA B | PLA A | S/C | 410 | 19 | 58.420 | 0.645 | Same as #50 except that the fiber was cut perpendicularly from the roll to create a nonwoven |
| 52 | PVA B | PLA A | S/C | — | 19 | — | — | Sheath core with melt speeds at 20 PVA/15 PLA rpm, then meltblown and calendared |
| 53 | PVA B | PLA A | Round | 30 | | | | Pure PLA extruded at 30 rpm |
| 54 | PVA B | PLA A | S/C | 568 | 19 | 59.810 | 0.320 | Sheath core with melt speeds at 4 PVA/16 PLA rpm |

TABLE 1-continued

| Preliminary Yarns & Fibers | | | | | | | | |
|---|---|---|---|---|---|---|---|---|
| Run | Comp. 1 | Comp. 2 | Shape | den (gpd) | FILA (#) | ELONG (%) | STR (kgf) | Notes |
| 55 | PVA B | PLA A | S/C | 621 | 19 | 26.040 | 8.150 | Sheath core with melt speeds at 10 PVA/10 PLA rpm |
| 56 | PVA B | PLA A | S/C | 0 | 19 | — | — | Sheath core with melt speeds at 20 PVA/10 PLA rpm |
| 57 | PVA B | PLA A | S/C | 0 | 19 | — | — | Nonwoven created with 20 PVA/20 PLA rpm, aspirated onto a moving belt and pressed firmly |
| 58 | PVA B | PLA A | S/C | 0 | 19 | — | — | Nonwoven created with 20 PVA/20 PLA rpm, aspirated onto a moving belt |
| 59 | PVA B | PLA A | S/C | 0 | 19 | — | — | Nonwoven created with 20 PVA/10 PLA rpm, aspirated onto a moving belt |
| 60 | PVA B | PLA A | S/C | 0 | 19 | — | — | Nonwoven created with 20 PVA/20 PLA rpm, aspirated into the collecting bag |
| 61 | PVA B | PLA A | S/C | 0 | 19 | — | — | Nonwoven created with 20 PVA/4 PLA rpm, aspirated into the collecting bag |
| 62 | PVA B | PLA A | S/C | 0 | 19 | — | — | Nonwoven created with 20 PVA/10 PLA rpm, aspirated into the collecting bag |
| 63 | PVA B | PLA A | S/C | 0 | 19 | — | — | Nonwoven created with 20 PVA/20 PLA rpm, aspirated onto a moving belt, treated with heat |
| 49c | PVA B | PLA A | | 577 | 19 | 137.370 | 0.830 | |
| 65 | PVA B | PLA A | | 290 | 19 | 32.385 | 0.860 | |
| 66 | PVA B | PLA A | | 384 | 19 | 60.325 | 0.840 | |
| 67 | PVA B | PLA A | | 320 | 19 | 62.018 | 0.776 | |
| 68 | PVA B | PLA A | | 243 | 19 | 24.977 | 0.780 | |
| 69 | PVA B | PLA A | | — | 19 | — | | |
| 70 | PVA B | | | 2553 | 30 | 17.145 | 1.808 | |
| 71 | PVA B | | | 1429 | 30 | 136.271 | 1.288 | |

Example 2—Woven Fabrics

Figure 9:
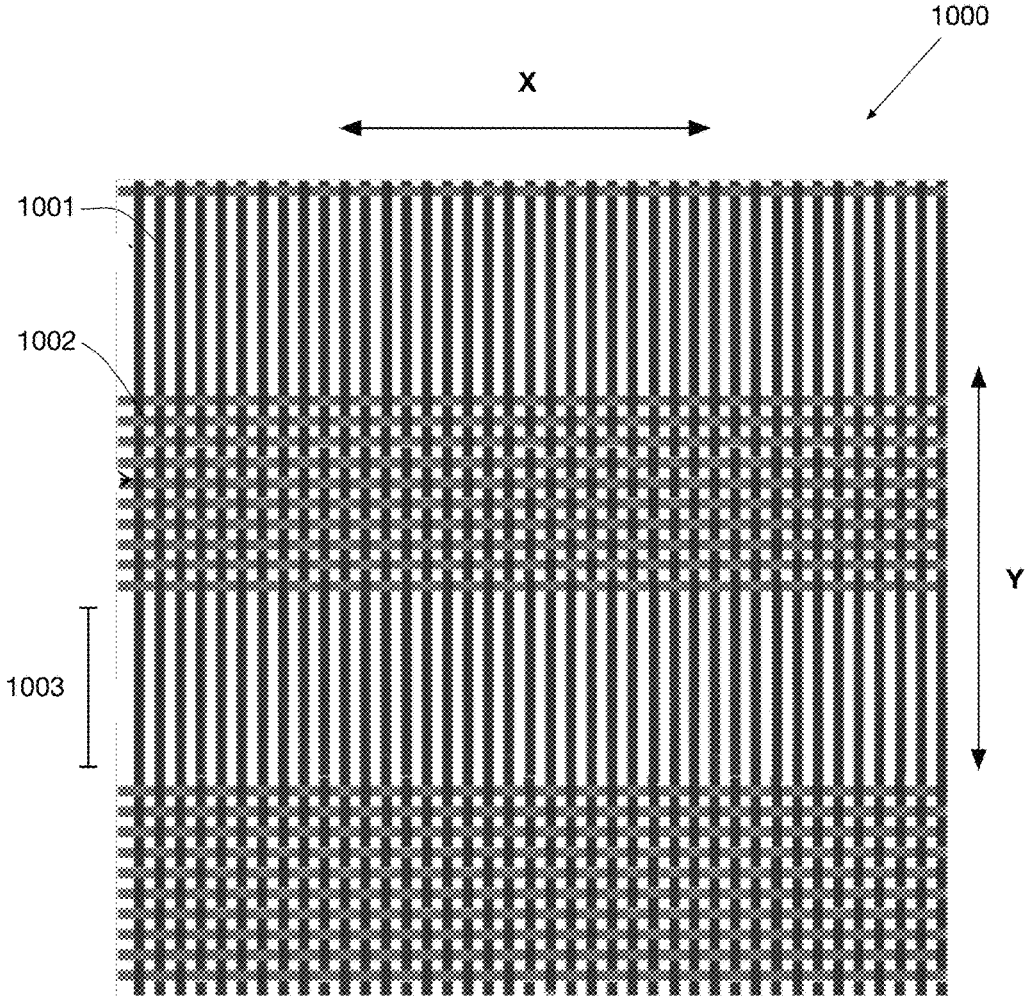
FIG. 9 shows an exemplary weaving pattern 1000 that may be employed to weave mono or multi-component fibers into exemplary propulsor occlusion device fabrics.

Referring to FIG. 9, a number of the yarns listed in Table 1 were woven into fabrics according to the illustrated weaving pattern 1000 by Inman Mills, Inc. The pattern comprises a number of warp 1001 threads running in a warp direction (Y). As shown, the Ends per Inch (EPI), or number of warp threads per inch of woven fabric, was set at 18.

The pattern comprises a number of pick or fill threads 1002 running in a fill direction (X) perpendicular to the warp direction (Y). As shown, the Picks per Inch (ppi), or number of fill threads per inch of woven fabric, was set to 18.

The pattern further comprises one or more gaps 1003, where fill threads were not included. As shown, a gap 1003 was included about every 0.5 inches. In order to achieve this, 9 fill yarns 1002 of the same type of material were woven, and then a 0.5 inch gap 1003 without fill yarns was skipped.

The weavings used extruded sample #55, as detailed in Table 1, as the warp yarn. Sample 55 comprises a bicomponent fiber having a 70% by weight PVA B core and a 30% by weight PLA A sheath. The PLA sheath was intended to keep the PVA from sticking to itself during the subsequent weaving process.

As shown in Table 2, a number of woven fabrics were created with varied filler materials. The identity of the fill yarns are documented in Table 2 where the OHMSETT 1 test matrix is documented (Tests 60-74). As an example, the first test in the OHMSETT 1 Tests (Test 60) refers to 44B which is a woven sample according to the pattern in FIG. 9, and having Sample 44 yarn from Table 1 as the fill yarn. Sample 44 yarn comprises a bicomponent fiber having a PVA B core and a PLA A sheath in a weight ratio of about 30:5.

TABLE 2

| Consolidated Testing | | |
|---|---|---|
| Test | Type | Details |
| 1 | Outboard Tank | Presoaked Sliver |
| 2 | Outboard Tank | 18" Unsoaked Sliver |
| 3 | Outboard Tank | 8.83 g Presoaked/Pre-wrapped Sliver |

TABLE 2-continued

Consolidated Testing

| Test | Type | Details |
|---|---|---|
| 4 | Outboard Tank | Plastic |
| 5 | Outboard Tank | 0.3 mil 8.8 g sheet |
| 6 | Outboard Tank | Presoaked Yarn (wet weight) |
| 7 | Outboard Tank | Unsoaked yarn |
| 8 | Outboard Tank | PVA Y-Fiber |
| 9 | Outboard Tank | PVA bags |
| 10 | Outboard Tank | Sample 13B |
| 11 | Outboard Tank | Chi Fiber |
| 12 | Outboard Tank | H Fiber |
| 13 | Outboard Tank | X Fiber |
| 14 | Outboard Tank | Octolobal |
| 15 | Outboard Tank | Plastic |
| 16 | Outboard Tank | H Fiber 3.86 g |
| 17 | Outboard Tank | H Fiber 8.16 g |
| 18 | Outboard Tank | 6032 Sliver |
| 19 | Outboard Tank | SAF |
| 20 | Outboard Tank | Netted SAF |
| 21 | Outboard Tank | Oasis |
| 22 | Outboard Tank | Heavy Needled PET |
| 23 | Outboard Tank | Light Need led PET |
| 24 | Ddata Summary | Silver - all kinds |
| 25 | Ddata Summary | #40 square |
| 26 | Ddata Summary | #39 square |
| 27 | Ddata Summary | #38 square |
| 28 | Ddata Summary | #38 square |
| 29 | Ddata Summary | #40 tentacles |
| 30 | Ddata Summary | Scrim |
| 31 | Ddata Summary | SAF/Scrim |
| 32 | Ddata Summary | cotton tentacles |
| 33 | Ddata V4 | E-CTP-1 |
| 34 | Ddata V4 | C-CTP-7 |
| 35 | Ddata V4 | C-CTP-8 |
| 36 | Ddata V4 | C-CTP-9 |
| 37 | Ddata V4 | C-WIN-1 |
| 38 | Ddata V4 | C-WIN-2 |
| 39 | Ddata V4 | Alma-2 |
| 40 | Ddata V4 | Alma-1 |
| 41 | Ddata V4 | D-CTP-1 |
| 42 | Ddata V4 | D-CTP-2 |
| 43 | Ddata V4 | D-CTP-3 |
| 44 | Ddata V4 | E-CTP-2 |
| 45 | Ddata V4 | E-CTP-3 |
| 46 | Ddata V4 | E-CTP-4 |
| 47 | Ddata V4 | E-CTP-5 |
| 48 | Ddata V4 | White Caterpillar |
| 49 | Ddata V4 | E-SQR-1 |
| 50 | Ddata V4 | H's CAT |
| 51 | Aberdeen | PVA007 |
| 52 | Aberdeen | PVA 035 |
| 53 | Aberdeen | PVA 035 + SAF Bottom Edge |
| 54 | Aberdeen | PVA 035 + SAF |
| 55 | Aberdeen | PVA 009 + SAF |
| 56 | Aberdeen | PVA 009 + 035 + 003 + SAF |
| 57 | Aberdeen | PVA 003 + 011 + 012 + SAF |
| 58 | Aberdeen | PVA 010 + 011 + 003 + SAF |
| 59 | Aberdeen | Mixed PVA + SAF + Borax/Castor oil |
| 60 | OHMSETT 1 | 44B woven |
| 61 | OHMSETT 1 | 53A woven |
| 62 | OHMSETT 1 | 45 woven |
| 63 | OHMSETT 1 | Hills Fabric 1 |
| 64 | OHMSETT 1 | NWH spunbond |

TABLE 2-continued

Consolidated Testing

| Test | Type | Details |
|---|---|---|
| 65 | OHMSETT 1 | Fabric FAB |
| 66 | OHMSETT 1 | Fabric woven + spun bond |
| 67 | OHMSETT 1 | Woven |
| 68 | OHMSETT 1 | OOIB-1067 |
| 69 | OHMSETT 1 | FAB PVA |
| 70 | OHMSETT 1 | Woven (Hills) |
| 71 | OHMSETT 1 | Spunbond |
| 72 | OHMSETT 1 | Woven tentacles |
| 73 | OHMSETT 1 | heart + star |
| 74 | OHMSETT 1 | 2 Rolls PVA |
| 75 | OHMSETT 2 | 6 × 5 × 1 |
| 76 | OHMSETT 2 | 5 × 5 × 1 |
| 77 | OHMSETT 2 | 4 × 5 × 1 |
| 79 | OHMSETT 2 | 2 × 5 × 1 |
| 80 | OHMSETT 2 | 1 × 5 × 1 |
| 81 | OHMSETT 2 | 1 × 5 × 3 Tetris |
| 82 | OHMSETT 2 | 5 × 5 × 3 Tetris |
| 83 | OHMSETT 2 | 10 × 5 × 1 |
| 84 | OHMSETT 2 | 15 × 5 × 1 |
| 85 | OHMSETT 2 | 15 × 5 × 1 |
| 86 | OHMSETT 2 | 20 × 5 × 1 |
| 87 | OHMSETT 2 | 25 × 5 × 1 |
| 88 | OHMSETT 2 | 30 × 5 × 1 |
| 89 | OHMSETT 2 | 7 × 5 × 1 |
| 90 | OHMSETT 2 | 31 × 5 × 1 |
| 91 | OHMSETT 2 | 45 × 5 × 1 |

Results

There was some difficulty in the weaving process because the yarn appeared to be drawing during the weaving process. It was found that the PLA fibers suffer from self-adhesion, which impeded the weaving process.

It was thought that with a thin sheath that the interior PVA would be easily exposed. However, initial testing showed that the PVA/PLA core/sheath configuration made the woven material hydrophobic, so much so that it did not wet and actually floated the cloth for an extended period of time. It was found that surfactants (e.g., soap) helped to wet out the material. Laboratory testing demonstrated that such surfactants helped to break the surface tension, reducing the hydrophobicity on the surface and allowed wetting of the material.

The woven materials showed limited success, so the nonwoven techniques of needle punch and spunbond were employed to make larger amounts of material moving forward.

Example 3—Nonwoven Fibers & Fabrics

As shown in Table 3, below, a number of fabric samples were produced at Hills, Inc. comprising fibers having a PVA/PLA or PLA/PVA core/sheath structure. Table 4 provides exemplary general parameters for a nonwoven process (the "BRD" Process) used to produce one or more fabric samples.

TABLE 3

Nonwoven Fibers & Fabric Samples

| Sample | Structure | Comp. 1 (Core) | Comp. 2 (Sheath) | Filaments (No.) | Line | Notes |
|---|---|---|---|---|---|---|
| 1 | Core/Sheath | 80% PVA B | 20% PLA B | 288 | BRD | |
| 2 | Core/Sheath | 80% PVA F | 20% PLA B | 288 | BRD | |
| 3 | Core/Sheath | 30% PLA B | 70% PVA C | 504 | BRD-3 | 3 dpf, 30 GSM |
| 4 | Core/Sheath | 50% PEO | 50% PLA B | 19 | LBRD | |

TABLE 3-continued

| Nonwoven Fibers & Fabric Samples | | | | | | |
|---|---|---|---|---|---|---|
| Sample | Structure | Comp. 1 (Core) | Comp. 2 (Sheath) | Filaments (No.) | Line | Notes |
| 5 | Core/Sheath | 50% PEO | 50% PLA B | 19 | LBRD | |
| 6 | Core/Sheath | 50% PVA C | 50% PLA B | 19 | LBRD | |
| 7 | Core/Sheath | 50% PVA C | 50% PVA D | 19 | LBRD | |
| 8 | Core/Sheath | 30% PVA C | 70% PVA D | 19 | LBRD | |
| 9 | Core/Sheath | 30% PVA C | 70% PVA D | 19 | LBRD | |
| 10 | Core/Sheath | 30% PVA C | 70% PVA D | 19 | LBRD | With Borax |
| 11 | Core/Sheath | 30% PVA C | 70% PVA D | 19 | LBRD | With Borax |
| 12 | Core/Sheath | 30% PLA B | 70% PVA C | 504 | BRD-3 | 150 GSM |
| 13 | Core/Sheath | 50% PVA G | 50% PLA B | 144 | BRD | Freefall |
| 14 | Hollow | — | 50% PLA B | 144 | BRD | |
| 15 | Core/Sheath | 50% PVA C | 50% PVA D | 144 | BRD | |
| 16 | Core/Sheath | 50% PVA C | 50% PVA D | 144 | BRD | |
| 17 | Delta | PLA B | — | 288 | BRD | |
| 18 | Core/Sheath | 30% PLA B | 70% PVA E | 504 | BRD-3 | 100 GSM |
| 19 | Core/Sheath | 30% PLA B | 70% PVA E | 504 | BRD-3 | 100 GSM |
| 20 | Core/Sheath | 30% PLA B | 70% PVA E | 504 | BRD-3 | 100 GSM |
| 21 | Segmented Pie | 30% PLA B | 70% PVA E | 504 | BRD-3 | 100 GSM |
| 22 | Core/Sheath | 30% PLA B | 70% PVA E | 504 | BRD-3 | 100 GSM |

TABLE 4

| BRD Nonwoven Process - General Parameters<br>General Parameters | |
|---|---|
| Holes No. | 288 |
| Holes Shape | Round |
| Hole Diam. | 0.35 |
| Spinneret | 288 FILS |
| P1 MP Size | 4.8 CC |
| P2 MP Size | 4.8 CC |
| Denier | 1250/4.3 |
| Tenacity | 1.5 |
| Elongation | 26% |
| Spin Finish Type | 3771 @ 12% |
| SF Source | Metered |
| Notes | Intermingler @ 30 PSI<br>2nd Pack with 0.004" SPACER<br>BRD |

As an example, a fabric was produced according to the nonwoven BRD-3 process comprising fibers having a core/sheath geometry, with a 30% by weight PLA B core and a 70% by weight PVA C sheath (see Table 3 at Sample 3). The fabric comprised 504 filaments, with a DPF of ~3 and a basis weight of 150 GSM.

Based on the Example 2 results, it was decided that the core/sheath orientation should be reversed, such that subsequent extrusions had a PLA core with PVA sheath. In a spunbond line, the adhesion of the filaments to each other does not interfere with the process so PVA could be employed as the sheath.

Figure 10:
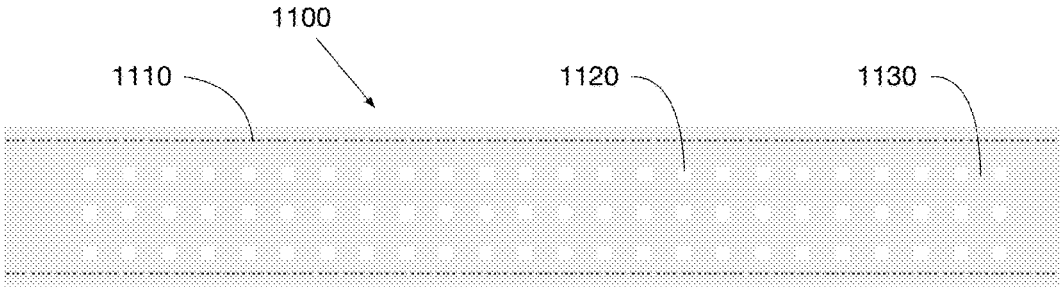
FIG. 10 illustrates the dimensions and physical characteristics of an exemplary spunbond propulsor occlusion fabric section 1100.

Referring to FIG. 10, the spunbond materials were post-processed at Clemson Apparel Research, as shown, to make samples 1100 suitable for particular target vessels. 85% of the nonwoven fabric was made into 5-ply, 1-roll width (20 inches), 10-ft long sections. The other 15% of the material was made into 1-ply, 1-roll width, 10-ft long sections. Samples 1100 were sewn 1110 at 3 stitches per inch, lockstitch, along the two long sides. For each sample, three rows of 2 inch×2 inch square windows 1120 were cut, separated by 3 inch muntins 1130. The "muntins" are analogous to the strips of wood separating and holding together panes of glass in a window.

The fabrics were then tested at the Oil Spill Responsible Research & Renewable Energy Test Facility (OHMSETT) in Leonardo, N.J. to determine a number of properties. OHMSETT's above ground concrete test tank is measures 203 meters long by 20 meters wide by 3.4 meters deep. The tank is filled with 2.6 million gallons of crystal clear saltwater. The test tank allows testing of full-scale equipment, and the tank's wave generator creates realistic sea environments, while state-of-the-art data collection and video systems record test results.

Results

Although the materials were capable of occluding propulsors, it was found that the 150 GSM basis weight was slightly heavy. Moreover, the square holes caused the material to tear at the corners of the holes.

In subsequent laboratory testing it was found that the bonds in the material made by the calendaring process went away as the PVA dissolved. This caused the material to become less of a coherent fabric than a mass of filaments.

Example 4—Intermediate Scale Testing of Woven Fabrics

As shown in Table 3, the fabrics comprised fibers having a core/sheath geometry, with a 30% by weight PLA B core and a 70% by weight PVA E sheath. The fabrics comprised 504 filaments, with a DPF of about 3 and a reduced basis weight of about 100 GSM.

Figure 11:
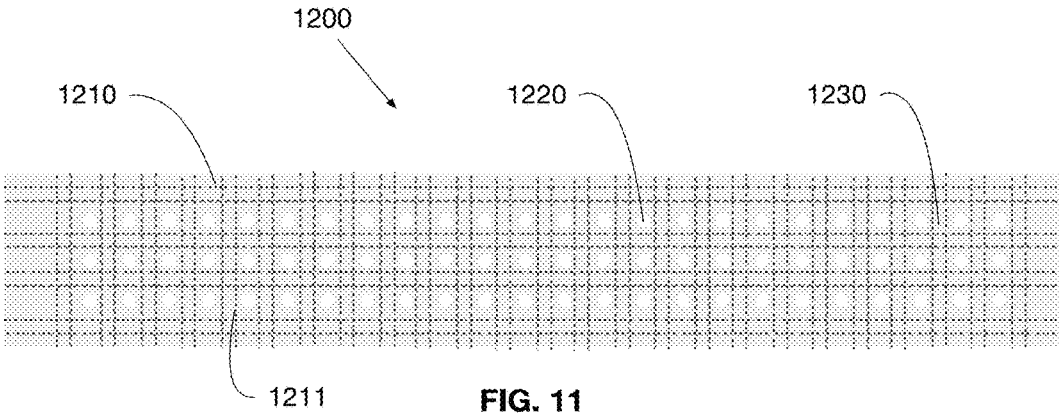
FIG. 11 illustrates the dimensions and physical characteristics of an exemplary spunbond propulsor occlusion fabric section 1200.

Referring to FIG. 11, the spunbond material were then post-processed, as shown, to make samples 1200 suitable for particular target vessels. In one test, 100% of the material was made into 15-ply, 1-roll width (20 inches), 22-ft long sections. Each sample 1200 was sewn at 3 stitches per inch, lockstitch, down the two long sides 1210. Reinforcement was also added to the assemblies by cross stitching 1211 the material. In each sample, three rows of 2 inch diameter windows 1220 were cut, separated by 3 inch muntins. It was decided to make circular holes 1220 in the fabric rather than square holes (see FIG. 10 at 1120) to eliminate tearing at the corners of the holes. The total amount of material delivered was about 5,000 yards of spunbond fabrics.

The materials were then tested at OHMSETT to determine a number of properties, including occlusion, wet-strength, water absorption, etc.

Results

Intermediate scale testing showed that 22 foot long samples were too short to effectively stop or slow a Landing Craft Mechanized, Mark 8 ("LCM8") target vessel. The LCM-8 is a river boat and mechanized landing craft used that weighs 135,000 pounds. LCM-8s are constructed from welded steel and powered by two 12V71 diesel engines, twin propellers, and rudders.

It was found that sewn fabrics comprising the core/sheath fabrics held together well. However, subsequent laboratory testing determined that the point bonds from the calendaring process were formed in the PVA sheath of the fiber. Since the PVA material dissolves quickly, the point bonds did not provide the material with a desired strength.

Based on this laboratory observation, it was determined to switch to a segmented pie fiber cross-section to increase the time the material stayed intact (see Table 3, Sample 21). The calendaring temperature was also increased to increase bonding. This material held together better but was more hydrophobic and "papery."

Example 5—Full Scale Testing of Woven Fabrics

A number of fabrics were produced at Hills, Inc. according to a spunbond nonwoven process. The fabrics comprised fibers corresponding to Samples 18-20 and 22 of Table 3.

Bicomponent, biconstituent fibers were produced comprising a core/sheath geometry, with a 30% by weight PLA B core and a 70% by weight PVA E sheath. The fibers were processed into fabrics according to the BRD-3 spunbond process, and the fabrics comprised 504 filaments, with a DPF of about 3 and a basis weight of 100 GSM.

Figure 12:
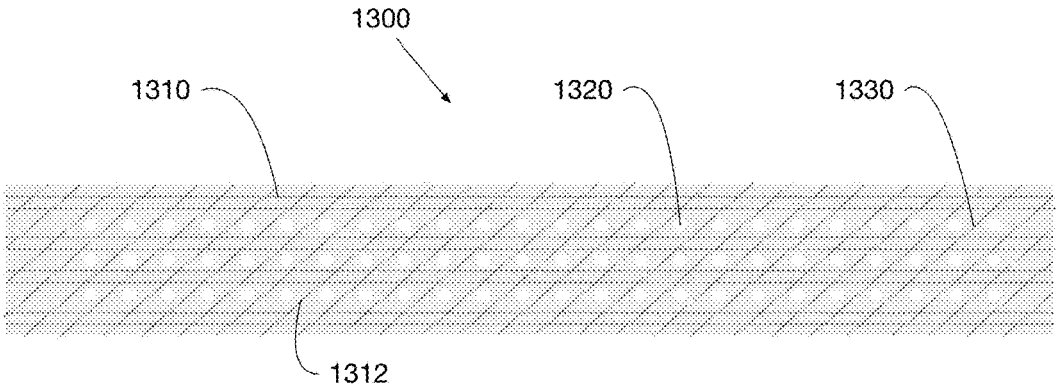
FIG. 12 illustrates the dimensions and physical characteristics of an exemplary spunbond propulsor occlusion fabric section 1300.
Figure 13:
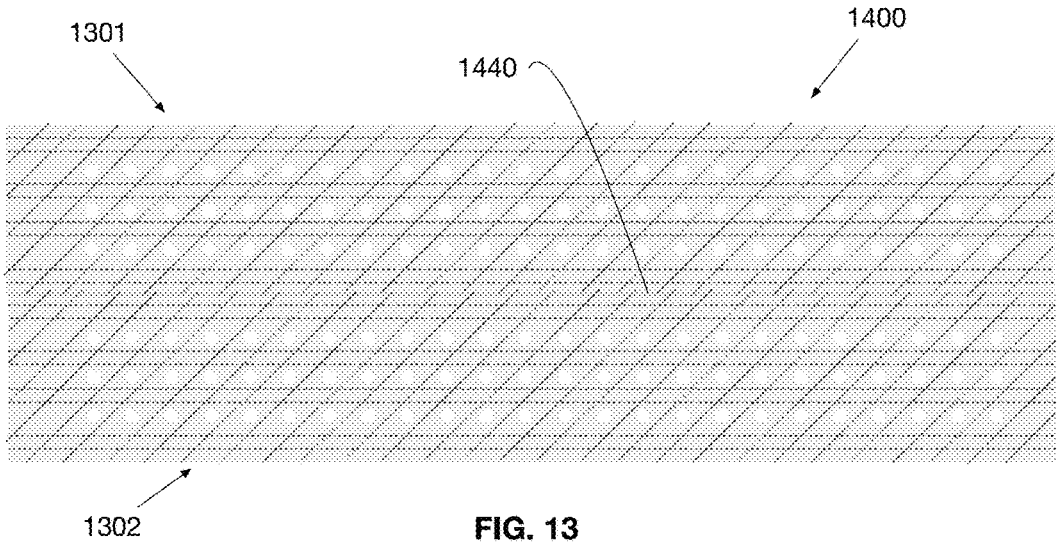
FIG. 13 illustrates the dimensions and physical characteristics of an exemplary doublewide spunbond propulsor occlusion fabric section 1400 comprising two sections according to FIG. 13 sewn together.

Referring to FIGS. 12 and 13, upon completion of the spunbond process the spunbond material was then post-processed, as shown, to make sections 1300 suitable for particular target vessels. 100% of the material was made into 15-ply, 1-roll width, 33-ft long sections 1300. The length of the sections 1300 was increased from 22-ft to 33-ft based on the results of the above experiment (see FIG. 11).

As shown, a number of the sections were used to create 15-ply, 2-roll width ("doublewide"), 33-ft long sections 1400. The doublewide samples 1400 were obtained by sewing 1440 together first 1301 and second 1302 1-roll-wide sections along one of the longer sides thereof.

It was found in intermediate scale testing that the sewn materials of the core/sheath fabric held together fairly well and it was therefore decided to modify the lockstitch pattern to take further exploit fabric longevity. Each sample was sewn at 3 stitches per inch, lockstitch, with ten seams down the length 1310 and diagonally across the width 1312. In each sample, three rows of 2 inch×2 inch circular windows 1320 were cut, separated by 3 inch muntins 1330. The total amount of material delivered was about 10,000 meters of spunbond fabric and the material was then tested at Panama City Beach.

Example 6—Material Buoyancy

A number of the materials listed in Tables 1-3, above, were tested to determine buoyancy and dissipation characteristics.

In one test, the inherent buoyancy of the materials was determined. A temperature-controlled water bath was provided and a weighed sample was suspended from a hook resting on an analytical balance. The material and hook were then submerged in the water bath for a predetermined time period. Care was taken to account for the amount of water displaced by the hook itself. The hook was weighed before and after immersion in the water.

During sample processing, stitching and mechanical cutting fused layers of material, trapping air pockets in some of the samples. Additionally, small bubbles can sometimes adhere to a fabric and makes it appear more buoyant. Tongs were used to gently squeeze the material in order to release bubbles trapped between layers.

The buoyancy of a material is simply the dry weight of the material minus the weight of the water that it displaces. Measurements can be complicated by the fact that some of these materials are water soluble, the weight changes with time. This characteristic was utilized to determine the rate of dissolution of the materials.

Results

Table 5, below, shows the apparent density of a number of materials used in this project. The measured weight, dry and submerged, are reported and the apparent density is calculated by dividing the dry weight by the amount of water displaced. The amount of water displaced is equal to the dry weight minus the buoyant weight. This number is a mass, but converts to volume using the density of fresh water as 1.0 grams per $cm^3$ at 25 C.

TABLE 5

Apparent Density of Propulsor Occlusion Materials

| | Material | Dry Weight (g) | Buoyant Weight (g) | Apparent Density (g/cc) |
|---|---|---|---|---|
| 1 | 45 ply spunbond 5 × 5 × 1 cm | 3.44 | 0.76 | 1.22 |
| 2 | Inman Mills woven fabric | 3.5 | 0.41 | 1.12 |
| 3 | Hills nonwoven fabric (30 GSM PLA sheath) | 3.6 | −1.68 | 0.53 |
| 4 | Oasis 6032 | 3.35 | 0.92 | 1.27 |
| 5 | 150 GSM | 4.99 | 0.96 | 1.19 |
| 6 | 100 GSM | 4.81 | 0.99 | 1.21 |
| 7 | Segmented Pie GSM | 5.18 | 0.68 | 1.13 |
| 8 | Foundations | 5.1 | −0.97 | 0.81 |
| 9 | Orange Laundry bag | 5.04 | 0.46 | 1.09 |
| 10 | 8071 PVA/Exceval 70/30 | 4.41 | 0.74 | 1.17 |
| 11 | 8071 PVA/Exceval 50/50 | 5.02 | 0.78 | 1.16 |
| 12 | segmented pie PLANichigo G | 2.09 | 0.63 | 1.30 |
| 13 | core sheath PLA/Nichigo G | 2.18 | 0.41 | 1.19 |
| 14 | core sheath PLA/Nichigo G which has been sewn together | 4.57 | 0.88 | 1.19 |
| 15 | New material 20141101 | 4.72 | 0.89 | 1.19 |
| 16 | Circles (cut edges intact) | 5.29 | 0.99 | 1.19 |
| 17 | Circles (plies separated) | 5.36 | 1.02 | 1.19 |
| 18 | Exceval/PLA | 5.59 | 0.93 | 1.17 |
| 19 | Clemson #7 (dipped in surfactant) | 5.3 | 0.94 | 1.18 |
| 20 | Clemson #9 (dipped in surfactant) | 5.05 | 0.52 | 1.10 |
| 21 | 3314.1/6202 PLA 70/30 | 5 | 1.03 | 1.21 |
| 22 | 3314.1/6202 PLA 50/50 | 6.4 | 1.37 | 1.21 |
| 23 | 3.088 DPF 50/50 | 6.83 | 1.39 | 1.20 |
| 24 | 3.088 DPF 70/30 | 5.33 | 1.16 | 1.22 |

In order for the propulsor occlusion material to stay at or near the top of the water column, the overall density of the material in water must be equal to or slightly less dense than water. The density of fresh water is 1.00 $g/cm^3$ and seawater is 1.03 $g/cm^3$.

As shown in the above Table 5, only two materials showed "positive buoyancy"—Samples 3 and 8. However, both of these samples had obvious air entrapped.

Excluding the outliers of the two materials that showed positive buoyancy, the average value is 1.18±0.05. This number helps to estimate the amount of buoyancy that will be required for a sample to make it neutrally buoyant. For instance, if one is deploying 10 kg of propulsor occlusion material the material displaces 8.5 liters of water (10 kg/1.18 kg/L). So, the effective weight of the material in water will be 1.5 kg. This means for it to be neutrally buoyant, one would have to add an additional 1.5 liters of displacement.

One of the largest samples tested at OHMSETT consisted of 150 plies of 150 GSM fabric that was 3 by 0.5 meters. The mass was 33.75 kg (150×0.15×3×0.5), which would displace 28.125 liters of water. The effective weight in water of the material would be 5.625 kg. So, in order for the sample to be neutrally buoyant, an additional 5.626 liters of water would need to be displaced.

As discussed above, one of the disclosed exemplary buoyancy bags displaces about 0.64 liters of water. To make this large sample buoyant would require 9 of these bags (e.g., 5.626 kg/0.64 L)=8.79 kg/L, round up to 9).

Example 7—Needle Punch Fabrics

Three needle punch fabrics were also tested to determine buoyancy properties. The fabrics were:

1. 80/20 SAF/PLA comprising Palmetto Synthetics PLA (2 inch fiber length) 100 strokes/min on needle loom
2. 90/10 SAF/PLA (same fiber as above) 100 strokes/min on needle loom
3. 90/10 SAF/PLA (same fiber as above) 150 strokes/min on needle loom It was found that these fabrics did not have the tensile strength to keep from tearing apart when saturated with water so hanging on a hook to measure water absoprtion was not possible. To accommodate the difficulty dealing with the needle punch material a different approach was utilized.

1. A square of fabric was cut out and weighed.
2. The square was placed in a sieve which was lowered into water submerging the fabric (non-buoyant) and allowed to soak undisturbed for 5 minutes.
3. After 5 minutes the sieve was carefully lifted from the water such that the SAF did not break free.
4. Unabsorbed water was allowed to drain from the fabric for approximately 15 seconds and then the sample weighed. Although an apparent density could not be calculated, the multiple of water weight absorbed by the sample could be estimated.
5. The fabric was then physically manipulated under gently running water by rubbing between fingers or rubbing over the mesh screen to wash away the shorter SAF leaving only the PLA.
6. The PLA was then dried in an oven and weighed.

Results

This process allowed for calculation of a percentage of the starting weight of material that would need to be accounted for in buoyancy accommodation. A triplicate analysis of these three needle punch fabrics is shown below in Table 6. The density of PLA as reported in the literature is 1.210-1.430 g/cc.

TABLE 6

| SAF/PLA Water Absorption | | | | | |
|---|---|---|---|---|---|
| | Sample 1 | Sample 2 | Sample 3 | AVG | STDEV |
| 80/20 SAF/PLA 100 strokes/min | | | | | |
| Multiple of water weight absorbed | 89.86 | 86.97 | 81.37 | 86.07 | 4.32 |
| Percentage of ending vs initial | 8.70 | 8.55 | 8.33 | 8.53 | 0.18 |

TABLE 6-continued

| SAF/PLA Water Absorption | | | | | |
|---|---|---|---|---|---|
| | Sample 1 | Sample 2 | Sample 3 | AVG | STDEV |
| 90/10 SAF/PLA 100 strokes/min | | | | | |
| Multiple of water weight absorbed | 57.56 | 68.88 | 78.90 | 68.45 | 10.68 |
| Percentage of ending vs initial | 11.06 | 10.70 | 10.77 | 10.84 | 0.19 |
| 90/10 SAF/PLA 150 strokes/min | | | | | |
| Multiple of water weight absorbed | 68.37 | 69.85 | 86.25 | 74.82 | 9.92 |
| Percentage of ending vs initial | 13.66 | 13.61 | 13.33 | 13.53 | 0.18 |

Example 8—Sap Wet-Strength

As an experiment, the aqueous solution shown in Table 7 was mixed and then dried under nitrogen to create an amorphous mass. The dry compound was then submerged in water for enough time to allow for approximately maximum water absorption. The compound was then removed and measurements were taken to determine the mass thereof.

TABLE 7

| PVA/SAP Compositions | |
|---|---|
| Component | % by Weight |
| Water | 80% |
| PVA | 10% |
| SAP | 10% |

Results

While the PVA/SAP mixture absorbed approximately 12 times its mass, there was an inverse relationship with the material's durability. After absorbing its dry weight in water, the gel had little structural integrity. Accordingly, it may be preferred to employ encapsulated SAP to provide additional wet-strength to the material.

Example 9—SAF Wet Strength

Technical Absorbents Limited (TAL) of Grimsby, North East Lincolnshire, United Kingdom produces a number of SAFs under their Oasis Superabsorbent Fibers (OASIS SAF®) line. The OASIS SAF® products comprises a cross-linked terpolymer of acrylic acid, methylacrylate and an amount of a special acrylate/methacrylate monomer in which the acrylic acid is partially neutralized to the sodium salt of acrylic acid. The cross-links between the polymer chains are formed as ester groups by reaction between the acid groups in the acrylic acid and the hydroxyl groups in the hydroxypropylmethacrylate. OASIS SAF® is available with variable degrees of cross-linking and in two general fiber types and sizes: long staple products (52 mm length & 10 dtex denier) and short staple products (6 mm length & 10 dtex denier).

As an experiment, the aqueous solution shown in Table 8 was mixed and then dried to create an amorphous mass. The SAF material used was TAL OASIS SAF® 6032, which comprises a 50:50 blend of SAF and polyester terapthalate (PET). It is was provided in sliver form (i.e., untwisted roving).

An exemplary propulsor occlusion fabric may be prepared including TAL OASIS SAF® 6032 material, which comprises as 50:50 ratio SAF and PET. Although these materials may break apart somewhat easily when put under hydrodynamic pressure on a propeller, the remaining PET fiber may be effective in occluding the propeller.

The dry compound was then submerged in water and a water soluble dye was added so that images could be obtained. The material was submerged for enough time to allow for approximately maximum water absorption and images were taken of the submerged compound. The compound was then removed so water absorption could be determined.

TABLE 8

SAF/PVA Compositions

| Component | % by Weight |
|---|---|
| Water | 90% |
| SAF (PET/SAP) | 10% |

Results

Throughout multiple tests, it was noted that SAPs are difficult to dissolve due to extreme hydrophilicity, and likely cross-linking by manufactures to ensure discreet granules. However, hand mixing PVA fibers with SAP into a nearly homogenous construct did show that PVA could contain the SAP, creating an expanding sticky mass when submerged in water.

To create more homogenous SAP solutions, the SAP may be dissolved in water at an elevated temperature. The ratio of water to fiber necessary for complete dissolution may be on the order of larger than about 400:1, about 500:1, about 600:1, about 700:1, about 800:1, about 900:1 or about 1000:1. This may necessitate a concentration step to create a solution capable of being wet spun into fibers and fabrics.

It was surprisingly found that co-extruding SAP and PVA polymers created a uniformly entangled yarn. Since SAP cannot be melt extruded into fibers, both polymers may be extruded from an aqueous solution in a process called dry spinning, so named because the removal of the solvent (water) via in-line heating creates a solid fiber. This yarn can then be either collected continuously on a bobbin, or extruded onto a belt to create a nonwoven fabric. The fabric can then be used to enhance propulsor occlusion constructs, or as a stand-alone device, depending on the final tensile properties required or desired.

In one embodiment, a homo-homo yarn extrusion process may be employed to incorporate SAPs into the exemplary PVA and/or PLA fabrics. The process incorporates wet spinning to simultaneously extrude SAP and PVA. The intent is for the PVA to provide strength and protection for the SAP. In another embodiment, graft copolymerization or formulations of mixtures of polymers may be employed to incorporate the SAPs in fabrics.

Example 10—Multivalent Cation/Anion Salts

Experiments were conducted to assess the attributes of additives that could potentially provide positive buoyancy through gas production, as well as added strength, duration, and ability to adhere to a metallic prop. To bypass the complexities of dry spinning, aqueous solutions were extruded into acetone by a syringe pump to create fibers in a process called wet spinning.

Wet spinning is an excellent bench top method for exploring fiber properties on a small scale, but is difficult to scale up and carries the risk of releasing trace amounts of solvent into the ocean. This process creates fibers that are collected in a beaker, and then dried in an oven under nitrogen to create a fibrous mass. The dried samples were then submerged in water, and their properties were noted over time.

Using this method, a number of multivalent cation and anion salts were combined with aqueous solutions of 10% by weight PVA and fibers were created. The experiments included borax, copper sulfate, sodium sulfate, calcium oxide, aluminum oxide, sodium bicarbonate, alginic acid, citric acid, and aluminum acetate. Solutions of 10% by weight PVA and 0.5%, 0.4%, 0.3% and 0.2% by weight of each additive were prepared and dried.

Each of the compounds were then processed into fibers via an extrusion process. The fibers were then observed and subjected to moisture to determine specific characteristics.

Results

Borax and sodium sulfate both were both found to be self-adhesive when exposed to water, and borax was mildly adhesive to steel. The 0.5% borax solution was too thick to be extruded, while the 0.4% solution created an excellent fiber. However, the 0.4% borax fiber was too resilient to water absorption, delaying its sticky properties for 10 minutes. The 0.3% and 0.2% borax solutions were both instantly sticky and very malleable. After 25 minutes the 0.3% borax fiber created a self-adhesive mass similar to dried rubber cement, and the 0.2% borax fiber had little structural integrity left.

The sodium sulfate samples were found to be self-adhesive when exposed to water. However, all of the sodium sulfate samples were more brittle than the borax samples.

Example 11—Toxicity & Environmental Compliance

In order to determine the toxicity of exemplary propulsor occlusion embodiments, samples were prepared as follows:

1. 50 g of fabric was weighed out and cut in to 1-2" squares.
2. Cut squares were added to deionized water, heated to approximately 90° C. with stirring heat plate.
3. After 3 hours of dissolution/extraction for 3 hours at 70-75° C., the heat was turned off and water was cooled in an ice bath.
4. Water was strained through a wire sieve to remove the remaining solids.
5. The chilled liquid was aliquoted into bottles for testing.

Tests were conducted according to the following standards to determine toxicity and environmental compliance:

1. Eden Research Testing, RCRA Toxicity Characteristic Leaching Procedure (TCLP) for VOCs, SVOCs, Chlorinated Pesticides and Herbicides, and Metals by SW-846 Method 1311 and Analysis
2. 5511 Standard Test Method for Determining Anaerobic Biodegradation of Plastic Materials Under High-Solids Anaerobic-Digestion Condition
3. 5988 Standard Test Method for Determining Aerobic Biodegradation of Plastic Materials in Soil.

Results

It was found that use of the inventive propulsor occlusion devices does not adversely affect public health or safety, does not involve effects on the human environment that are uncertain, does not threaten a violation of law applicable to the Department of the Navy, involve unique or unknown risk or are scientifically controversial.

Testing found no concentrations of concern, confirming assertions made in the record of categorical exclusion. Specifically: VOC, SVCOCs, chlorinated herbicides, organo-chlorinated pesticides, TCLP priority metals and other TCLP components were tested by EPA, or other ELAP, methods.

The propulsor occlusion devices may meet all requirements of each of the enumerated laws and regulations in Table 9, below.

TABLE 9

Federal & State Environmental Laws and Regulations

| Environmental Law | Federal or State Law | Responsible Agency | Regulated Activity and Resource |
|---|---|---|---|
| California Coastal Act (CCA) (PRC §30000 et. seq.) | State | CCC/BCDC | Activities that modify land or water use in the coastal zone |
| California Endangered Species Act (CESA) (FGC § 2081 & 2090) | State | CDFW | Activities affecting state-listed species |
| California Environmental Quality Act (CEQA) (PRC § 21000-21177) | State | OPR and SCH (oversight) | Discretionary actions proposed to be carried out or approved by California public agencies |
| Section 401, Clean Water Act (CWA) (33 USC 1341) | Federal | SWRCB (EPA oversight) | Discharges requiring a federal license or permit to comply with state or federal water quality standards |
| Section 402, Clean Water Act (CWA) (33 USC 1342) | Federal | SWRCB | Point source discharges to surface waters of the U.S. |
| Coastal Zone Management Act (CZMA) (16 USC 1451) | Federal | NOAA | Project modifies land or water use in the coastal zone of a state with an approved CMP |
| Section 7 & 10, Endangered Species Act (16 USC 1531-1544) | Federal | USFWS/NMFS | Activities affecting species listed as threatened or endangered under the ESA |
| Marine Mammal Protection Act (MMPA) (16 USC 1361 et. seq.) | Federal | USFWS/NMFS | Activities affecting marine mammals and their products |
| National Environmental Policy Act (NEPA) (42 USC 4312) | Federal | CEQ and EPA oversight | Major federal actions significantly affecting the quality of the human environment |
| Porter-Cologne Water Quality Control Act (Division 7, California Water Code) | State | SWRCB | Activities that may affect surface or groundwater quality |
| Vessel General Permit, 402, 33 U.S.C. 1342. | Federal | EPA | 26 general discharges from the normal operations of vessels |
| MARPOL, Act to Prevent Pollution from Ships (Act to Prevent Pollution from Ships, 33 U.S.C. §§ 1901-1915) | Federal | EPA | Compliance by typically Excluded vessels which include those from US Navy and Coast Guard |
| Uniform National Discharge Standards 33 U.S.C. § 312(n) | Federal | DoD | Discharges from military and coast guard vessels from the coast to 12 miles at sea |
| California Ocean Plan, State Water Resources Control Board, CH&S 25117 et. seq. | State | SWRCB | Point Source and Vessel discharges, areas of special biological significance Delineated, standards set |
| Resource Conservation Recovery Act - 42 U.S.C. ch. 82 § 6901 et seq | Federal | EPA | Ocean Discharge and Dumping |

Acronyms:
ACHP - Advisory Council on Historic Preservation
BCDC - San Francisco Bay Conservation and Development Commission
CCC - California Coastal Commission
CDFW - California Department of Fish and Wildlife
CEQ - Council on Environmental Quality
EPA - Environmental Protection Agency
NMFS - National Marine Fisheries Service
NOAA - National Oceanic & Atmospheric Administration
OCRM - Office of Ocean & Coastal Resource Management
OPR - Office of Planning and Research
RWQCB - Regional Water Quality Control Board
SCH - State Clearinghouse
SHPO - State Historic Preservation Officer
SWRCB - State Water Resources Control Board
USACE - U.S. Army Corps of Engineers
USFWS - U.S. Fish and Wildlife Service As discussed above, the advantages of the present embodiments are numerous. Propulsor occlusion device embodiments are provided that can slow and/or incapacitate a marine vessel without harming or destroying the vessel's propulsion system and without seriously injuring any of the occupants of the vessel. The exemplary compositions have been shown to be an effective non-lethal means of stopping or slowing a vessel. The propulsor occlusion devices can be deployed safely by a diver, a seagoing vessel or an aircraft well before a chase ensues. Moreover, the deployed materials may be safely left in the water for extended periods of time, as they comprise GRAS materials that dissolve and/or biodegrade with a relatively short time period.

The effectiveness of the materials has been shown to increase by incorporating one or more superabsorbent materials (e.g., SAPs and SAFs). Moreover, the adhesiveness has been shown to increase when combining SAPs with PVA polymer. Such materials were shown to gel quickly and dissolve more slowly.

The exemplary embodiments can relate to one or more propulsor occlusion devices for performing one or more of the functions described herein. This device(s) may be specially constructed for the required purpose. Other exemplary embodiments can relate to one or more components that make up the propulsor occlusion device, such as a single fabric or a number of fabrics in combination.

The embodiments described and claimed herein is not to be limited in scope by the specific examples herein disclosed since these examples are intended as illustrations of several aspects of the embodiments. Any equivalent examples are intended to be within the scope of the embodiments. Indeed, various modifications of the embodiments in addition to those shown and described herein will become apparent to those skilled in the art from the foregoing description. Such modifications are also intended to fall within the scope of the appended claims. All references including patents, patent applications and publications cited herein are incorporated herein by reference in their entirety and for all purposes to the same extent as if each individual publication or patent or patent application was specifically and individually indicated to be incorporated by reference in its entirety for all purposes.

We claim:

1. A propulsor occlusion device for use in slowing a marine vessel in a body of water, the device comprising:

multiple strips of fabric having a basis weight of from about 75 to about 150 g/m2 (GSM) and comprising a plurality of bonded fibers, the fibers comprising:

from about 65% to about 80% by weight polyvinyl alcohol (PVA); and from about 20% to about 35% by weight polylactic acid (PLA), wherein the multiple strips of fabric are fastened together at a first end thereof using a biodegradable fastening means and the multiple strips are braided together leaving second ends thereof non-fastened;

wherein when the propulsor occlusion device is submerged into the body of water, the multiple strips of fabric absorb water, expand, separate at the second non-fastened ends and adhere to a propulsor of the marine vessel to reduce the propulsor's thrust generation and thereby slow the marine vessel.

2. The propulsor occlusion device of claim 1, wherein the fabric is a non-woven fabric.

3. The propulsor occlusion device of claim 2, wherein the fabric is a spunbond non-woven fabric.

4. The propulsor occlusion device of claim 1, wherein the fabric comprises a basis weight of about 100 GSM.

5. The propulsor occlusion device of claim 4, wherein the denier per filament is about 3.

6. The propulsor occlusion device of claim 5, wherein the fabric comprises a thickness of one or more sheets and each sheet comprises about 504 bound fibers.

7. The propulsor occlusion device of claim 1, wherein the fibers are bicomponent fibers having a configuration selected from the group consisting of: side-by-side, sheath-core, segmented pie, hollow pie wedge, three island, and island-in-the-sea.

8. The propulsor occlusion device of claim 7, wherein the fibers comprise a sheath-core configuration with a PVA sheath and a PLA core.

9. The propulsor occlusion device of claim 8, wherein the fibers comprise about 70% by weight PVA and about 30% by weight PLA.

10. The propulsor occlusion device of claim 1, wherein the fabric further comprises one or more strength members sewn along a length and a width thereof.

11. The propulsor occlusion device of claim 10, wherein the fabric further comprises one or more strength members sewn diagonally across the width thereof.

12. The propulsor occlusion device of claim 1, wherein the fabric comprises one or more apertures throughout a length thereof defining a row of apertures.

13. The propulsor occlusion device of claim 12, wherein the fabric comprises a plurality of rows of apertures throughout a width thereof.

14. The propulsor occlusion device of claim 1, wherein strip comprises a thickness of from about 10 to about 20 sheets of fabric bonded together.

15. The propulsor occlusion device of claim 14, wherein the number of sheets is 15.

16. The propulsor occlusion device of claim 1, further comprising one or more superabsorbent materials.

17. The propulsor occlusion device of claim 16, wherein the superabsorbent material is sodium polyacrylate.

18. The propulsor occlusion device of claim 1, further comprising one or more of: sodium alginate, sodium borate, beeswax, calcium, basalt, citric acid and sodium bicarbonate.

19. The propulsor occlusion device of claim 1, wherein the multiple strips of fabric comprise a second strip of fabric fastened to first strip of fabric.

20. The propulsor occlusion device of claim 1, wherein the propulsor occlusion device does not prevent the propulsor from rotating when adhered thereto.

21. The propulsor occlusion device of claim 1, wherein the propulsor occlusion device maintains a occlusion capable of slowing the vessel for up to about 24 hours after deployment in water.

22. The propulsor occlusion device of claim 1, wherein the propulsor occlusion device degrades into pieces of less than about 2 inches in length within from about 6 hours to about 48 hours after deployment.

* * * * *